US010823490B2

(12) United States Patent
Kumar et al.

(10) Patent No.: US 10,823,490 B2
(45) Date of Patent: Nov. 3, 2020

(54) SHELF ASSEMBLY FOR APPLIANCE

(71) Applicant: WHIRLPOOL CORPORATION, Benton Harbor, MI (US)

(72) Inventors: Shrawan Kumar, St. Joseph, MI (US); Pranav, St. Joseph, MI (US); Kundan Rawate, Maharashtra, IN (US); Antonio Sanchez, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 72 days.

(21) Appl. No.: 15/782,169

(22) Filed: Oct. 12, 2017

(65) Prior Publication Data

US 2019/0113273 A1 Apr. 18, 2019

(51) Int. Cl.

| | |
|---|---|
| ***F25D 25/02*** | (2006.01) |
| ***A47B 96/02*** | (2006.01) |
| ***F25D 23/06*** | (2006.01) |
| *A47F 3/04* | (2006.01) |
| *F25D 11/00* | (2006.01) |

(52) U.S. Cl.

CPC ..... *F25D 25/02* (2013.01); *A47B 96/021* (2013.01); *F25D 23/067* (2013.01); *A47F 3/0486* (2013.01); *F25D 11/00* (2013.01); *F25D 2325/021* (2013.01); *F25D 2325/022* (2013.01)

(58) Field of Classification Search

CPC ..... F25D 25/02; F25D 23/067; F25D 25/024; F25D 2325/022; A47B 96/021

See application file for complete search history.

(56) References Cited

U.S. PATENT DOCUMENTS

| | | | |
|---|---|---|---|
| 2,282,342 | A | 5/1942 | Preble |
| 2,517,385 | A | 8/1950 | Clark |
| 2,573,272 | A | 10/1951 | Petkwitz |
| 2,597,267 | A | 5/1952 | Shoemaker et al. |
| 2,737,782 | A | 3/1956 | Antico |
| 2,748,573 | A | 6/1956 | Staebler et al. |
| 3,866,437 | A | 2/1975 | Spencer |
| 4,638,644 | A | 1/1987 | Gidseg |

(Continued)

FOREIGN PATENT DOCUMENTS

| | | | |
|---|---|---|---|
| BR | PI0100491 | B1 | 6/2009 |
| BR | PI0805999 | A2 | 6/2010 |

(Continued)

*Primary Examiner* — Kimberley S Wright

(74) *Attorney, Agent, or Firm* — Price Heneveld LLP

(57) ABSTRACT

A shelf assembly for a refrigerator includes a frame assembly having front and rear frame members with respective front and rear channels. A panel includes first and second ends, wherein the first end is fully received in the front channel, and further wherein the second end is partially received in the rear channel. A spacer assembly includes a spacer member and one or more clip members extending upwardly from a base portion. The clip members are clipped to mounting apertures disposed on the second portion of the rear frame member. The spacer member is received through a receiving aperture disposed through the rear frame member. The spacer member extends into the rear channel and engages the second end of the panel when the spacer assembly is clipped to the rear frame member to retain the panel in the channels of the front and rear frame members.

20 Claims, 19 Drawing Sheets

(56) References Cited

U.S. PATENT DOCUMENTS

| | | | | |
|---|---|---|---|---|
| 4,665,676 | A * | 5/1987 | Drzemala | A47G 1/0605 52/656.9 |
| 4,732,435 | A | 3/1988 | Bailey et al. | |
| 4,834,557 | A | 5/1989 | Dreinhoff | |
| 4,914,928 | A | 4/1990 | Fellwock et al. | |
| 4,998,382 | A | 3/1991 | Kostos et al. | |
| 5,362,145 | A | 11/1994 | Bird et al. | |
| 5,524,981 | A | 6/1996 | Herrmann et al. | |
| 5,564,809 | A | 10/1996 | Kane et al. | |
| 5,660,777 | A | 8/1997 | Herrmann et al. | |
| 5,813,741 | A | 9/1998 | Fish et al. | |
| 5,918,959 | A | 7/1999 | Lee | |
| 6,045,101 | A | 4/2000 | Goyette et al. | |
| 6,174,482 | B1 | 1/2001 | Reames et al. | |
| 6,474,094 | B2 | 11/2002 | Kim | |
| 6,488,347 | B1 | 12/2002 | Bienick | |
| 6,604,800 | B2 | 8/2003 | Hamilton | |
| 6,811,045 | B1 | 11/2004 | Masker et al. | |
| 7,178,890 | B2 | 2/2007 | Park et al. | |
| 7,232,194 | B2 | 6/2007 | Becke et al. | |
| 7,270,385 | B2 | 9/2007 | Mathur et al. | |
| 7,651,182 | B2 | 1/2010 | Eveland et al. | |
| 7,748,806 | B2 | 7/2010 | Egan | |
| 8,172,347 | B2 | 5/2012 | Lim et al. | |
| 8,297,726 | B2 | 10/2012 | Ramm et al. | |
| 8,336,976 | B2 | 12/2012 | Lee | |
| 8,348,362 | B2 | 1/2013 | Candeo et al. | |
| 8,359,881 | B2 | 1/2013 | Junge et al. | |
| 8,414,095 | B2 | 4/2013 | Stewart | |
| 8,534,783 | B2 * | 9/2013 | Nash | F25D 25/02 108/108 |
| 8,616,665 | B2 | 12/2013 | Czach et al. | |
| 8,640,482 | B2 | 2/2014 | Lim et al. | |
| D710,406 | S | 8/2014 | Seo et al. | |
| 8,833,882 | B2 | 9/2014 | Seo et al. | |
| 8,960,826 | B2 | 2/2015 | Choo et al. | |
| 9,033,437 | B2 | 5/2015 | Klitzing et al. | |
| 9,097,457 | B2 | 8/2015 | Kim | |
| 9,127,878 | B2 | 9/2015 | Gossens et al. | |
| 9,217,601 | B2 | 12/2015 | Koo et al. | |
| 9,234,690 | B2 | 1/2016 | McCollugh et al. | |
| 9,250,010 | B2 * | 2/2016 | De La Garza | F25D 25/024 |
| 9,328,955 | B2 | 5/2016 | Castro Solis et al. | |
| 9,339,993 | B2 | 5/2016 | Cites et al. | |
| 9,488,405 | B2 | 11/2016 | Lee et al. | |
| 9,500,403 | B2 | 11/2016 | Seo et al. | |
| 9,945,601 | B1 * | 4/2018 | Bhavsar | F25D 25/02 |
| 2004/0012314 | A1 | 1/2004 | Hay et al. | |
| 2006/0145577 | A1 | 7/2006 | Daley et al. | |
| 2006/0254481 | A1 * | 11/2006 | Lee | F25D 25/02 108/108 |
| 2007/0126325 | A1 | 6/2007 | Gorz et al. | |
| 2008/0000260 | A1 * | 1/2008 | Lim | A47B 96/02 62/465 |
| 2008/0203041 | A1 | 8/2008 | Lim et al. | |
| 2008/0203879 | A1 * | 8/2008 | Lim | F25D 25/02 312/408 |
| 2009/0033188 | A1 * | 2/2009 | Becke | F25D 25/02 312/404 |
| 2010/0024464 | A1 | 2/2010 | Hwang et al. | |
| 2010/0109498 | A1 | 5/2010 | Ramm et al. | |
| 2010/0181884 | A1 * | 7/2010 | De La Garza | F25D 25/024 312/408 |
| 2011/0062845 | A1 * | 3/2011 | Leconte | A47B 96/02 312/408 |
| 2011/0089800 | A1 | 4/2011 | Nash et al. | |
| 2012/0104924 | A1 * | 5/2012 | Nash | F25D 25/02 312/408 |
| 2012/0104925 | A1 * | 5/2012 | Nash | F25D 25/02 312/408 |
| 2012/0126679 | A1 * | 5/2012 | Bai | F25D 25/02 312/408 |
| 2015/0034668 | A1 | 2/2015 | Minard et al. | |
| 2015/0061484 | A1 | 3/2015 | Jeong et al. | |
| 2015/0168048 | A1 | 6/2015 | Sexton et al. | |
| 2015/0184929 | A1 | 7/2015 | Moon | |
| 2016/0290707 | A1 | 10/2016 | Burke et al. | |

FOREIGN PATENT DOCUMENTS

| | | | |
|---|---|---|---|
| CN | 202432813 | U | 9/2012 |
| DE | 8801508 | U1 | 6/1989 |
| DE | 102009045363 | A1 | 4/2011 |
| DE | 102013216974 | A1 | 4/2014 |
| EP | 1790250 | A2 | 5/2007 |
| EP | 2072937 | A2 | 6/2009 |
| EP | 2098810 | A2 | 9/2009 |
| JP | H10115485 | A | 5/1998 |
| JP | H10122733 | A | 5/1998 |
| JP | H11237173 | A | 8/1999 |
| KR | 20040095421 | A | 11/2004 |
| KR | 20100023474 | A | 3/2010 |
| KR | 20060063492 | * | 6/2012 |
| WO | 2004104504 | A1 | 12/2004 |
| WO | 2005012812 | A1 | 2/2005 |
| WO | 2007128734 | A1 | 11/2007 |
| WO | 2009136078 | A2 | 11/2009 |
| WO | 2011009773 | A2 | 1/2011 |
| WO | 2011080109 | A2 | 7/2011 |
| WO | 2012025382 | A2 | 3/2012 |
| WO | 2012062670 | A2 | 5/2012 |
| WO | 2013126515 | A1 | 8/2013 |
| WO | 2015101430 | A1 | 7/2015 |
| WO | 2015101434 | A1 | 7/2015 |
| WO | 2015149832 | A1 | 10/2015 |
| WO | 2015165531 | A1 | 11/2015 |
| WO | 2016131603 | A1 | 8/2016 |
| WO | 2016155784 | A1 | 10/2016 |
| WO | 2017005314 | A1 | 1/2017 |

* cited by examiner

SHELF ASSEMBLY FOR APPLIANCE

BACKGROUND

Many refrigerated appliances include shelving systems to divide a storage compartment for maximizing the amount of items that can be stored in the appliance. Glass shelves are often provided to increase the visibility of items from the user's view point. When using glass shelves, trims are coupled to the glass inserts, such that the shelves can be supported from the trim structures. Trim structures are often attached to the shelves frames using an adhesive material. The adhesives can be cured by ultraviolet rays. These manufacturing procedures are very critical, and mostly done with robotic arms in a controlled environment. Thus, assembly of such glass shelves is very costly. Further, the assembly process is very sensitive to surrounding environment conditions like cleanliness, amount of adhesive used, and location of the adhesive. These processes may require frit on the glass to hide the glue, which affect the overall aesthetic of the shelf assembly. Further, the adhesives can have a thickness that is uneven and unsightly. Thus, a shelf assembly is desired wherein glass inserts are assembled to frame structures and mechanically retained in place without the need for adhesives.

SUMMARY

According to one aspect of the disclosure, a shelf assembly includes a frame assembly having front and rear frame members, wherein each of the front and rear frame members include first and second portions spaced-apart from one another to define front and rear channels therebetween. A glass panel includes first and second ends, wherein the first end is fully received in the front channel of the front frame member, and further wherein the second end is partially received in the rear channel, such that a gap is defined between the second end of the glass panel and an end wall downwardly extending from an underside of the first portion of the rear frame member. A spacer assembly includes a base portion with one or more spacer members extending upwardly from the base portion and one or more clip members extending upwardly from the base portion the clip members of the spacer assembly are clipped to one or more mounting apertures disposed through the second portion of the rear frame member, and the spacer members are received through one or more receiving apertures disposed through the second portion of the rear frame member. The spacer members extend into the gap of the rear channel and engage the second end of the glass panel when the at least one spacer assembly is clipped to the second portion of the rear frame member.

According to another aspect of the present disclosure, a shelf assembly includes a frame assembly having first and second frame members spaced-apart to define a receiving area therebetween. The first frame member includes a first channel, and the second frame member includes a second channel having an access slot disposed through an underside thereof. A glass panel includes first and second ends and is received in the receiving area. The first end of the glass panel is received in the first channel of the first frame member, and the second end of the glass panel is received in the second channel of the second frame member. A gap is defined between the second end of the glass panel and an end wall extending into the second channel. A spacer assembly is releasably coupled to the second frame member. The spacer assembly includes a base portion with first and second spaced-apart arms upwardly extending therefrom. The first and second arms of the spacer assembly are received in the second channel of the second frame member through the access slot at the gap defined therein. The first arm engages the second end of the glass panel when the spacer assembly is coupled to the second frame member.

According to yet another aspect of the present disclosure, a shelf assembly includes a first frame member having upper and lower portions that are spaced-apart from each other to define a first channel therebetween. A second frame member is spaced-apart from the first frame member to partially define a receiving area therebetween. The second frame member includes upper and lower portions that are spaced-apart from one another to define a second channel therebetween. A panel includes first and second ends, wherein the panel is received in the receiving area and operable between a first position, wherein the second end is received in the second channel, and a second position, wherein the first end is received in the first channel and the second end is received in the second channel. A gap is formed in the second channel when the panel is in the second position. A spacer assembly is removeably received in the gap of the second channel to retain the panel in the second position.

These and other features, advantages, and objects of the present disclosure will be further understood and appreciated by those skilled in the art by reference to the following specification, claims, and appended drawings.

BRIEF DESCRIPTION OF THE DRAWINGS

The foregoing summary, as well as the following detailed description of the disclosure, will be better understood when read in conjunction with the appended drawings. For the purpose of illustrating the disclosure, certain examples are shown in the drawings. It should be understood, however, that the disclosure is not limited to the precise arrangements and instrumentalities shown. Drawings are not necessarily to scale. Certain features of the disclosure may be exaggerated in scale or shown in schematic form in the interest of clarity and conciseness.

In the drawings.

DETAILED DESCRIPTION OF EMBODIMENTS

Figure 1:
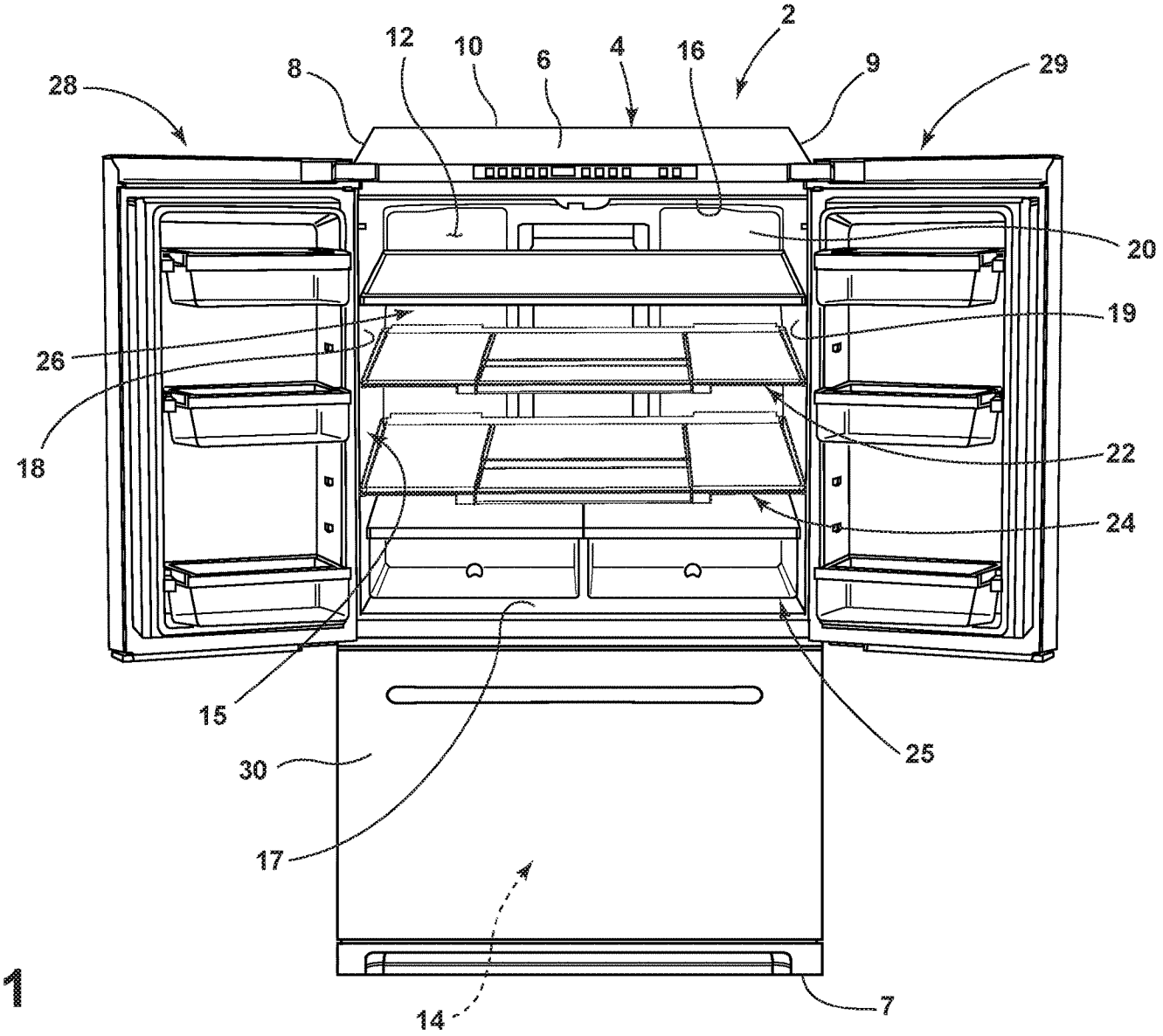
FIG. 1 is a front top perspective view of a refrigerator having a number of shelf assemblies according an embodiment of the present concept.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIG. 1, the reference numeral 2 general designates a bottom-mount refrigerator for use with the present concept. The refrigerator 2 is shown having a bottom-mount configuration, however, it is contemplated that a top-mount, side-by-side, or other style refrigerator could be used with the present concept. The refrigerator 2 includes a cabinet 4 having a top wall 6, a bottom wall 7, opposing sidewalls 8 and 9, and a rear wall 10 which cooperate to define first and second compartments 12 and 14. In the embodiment shown in FIG. 1, the first compartment 12 is disposed above the second compartment 14. As shown, the first compartment 12 includes a liner 15 having a top wall 16, a bottom wall 17, opposing sidewalls 18 and 19 and a rear wall 20. A first shelf assembly 22 and a second shelf assembly 24 are shown disposed within the first compartment 12 and are contemplated to be supported by sidewalls 18, 19 of the liner 15, and may further be supported by the rear wall 20 of the liner 15. A third shelf assembly 26 is shown disposed above the first and second shelf assemblies 22, 24 within the first compartment 12.

As further shown in FIG. 1, the refrigerator 2 includes first and second doors 28 and 29. The first and second doors 28 and 29 are engaged by a user to selectively provide access to the first compartment 12. Specifically, the first and second doors 28, 29 are pivotally coupled to the cabinet 4 for pivoting movement relative thereto. In FIG. 1, the second compartment 14 is selectively accessed via a door 30 which may be a sliding drawer-style door. Thus, the refrigerator 2 is a bottom mount refrigerator with lower freezer door 30 being adapted to slide in and out of the cabinet 4 to provide access to frozen items stored within second compartment 14.

Figure 2:
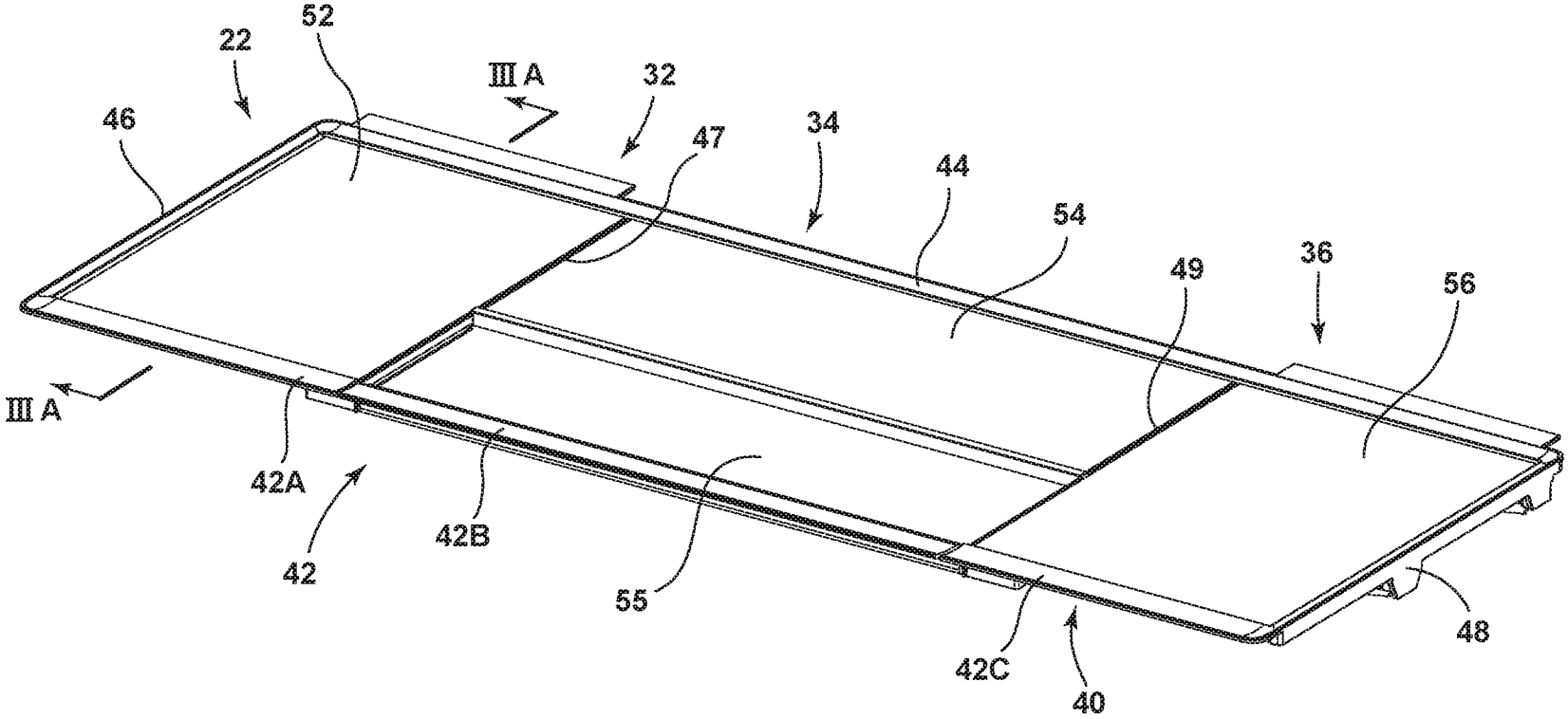
FIG. 2 is a top perspective view of a shelf assembly of FIG. 1 as removed from the refrigerator.

Referring now to FIG. 2, a glass shelf assembly 22 is shown having first and second side portions 32, 36 with an intermediate portion 34 disposed therebetween. The glass shelf assembly 22 includes front and rear frame members 42, 44, and opposing side frame members 46, 48 which are interconnected to define a peripheral frame assembly 40. The peripheral frame assembly 40 is contemplated to be comprised of a molded plastic material that is adapted to receive one or more glass panels during an assembly of the shelf assembly 22. In the embodiment shown in FIG. 2, the front frame member 42 includes three sections shown as sections 42A, 42B and 42C, which coincide with the first side portion 32, the intermediate portion 34, and the second side portion 36, respectively. In the embodiment shown in FIG. 2, the rear frame member 44 is a unitary member. A plurality of glass panels are shown supported by the peripheral frame assembly 40 and are identified herein as glass panels 52, 54 and 56, which coincide with the first side portion 32, the intermediate portion 34, and the second side portion 36, respectively. The intermediate portion 34 is sectioned off by intermediate side frame members 47, 49 and includes an adjustable glass panel 55 which is contemplated to be adjustable between retracted and deployed positions.

Figure 3A:
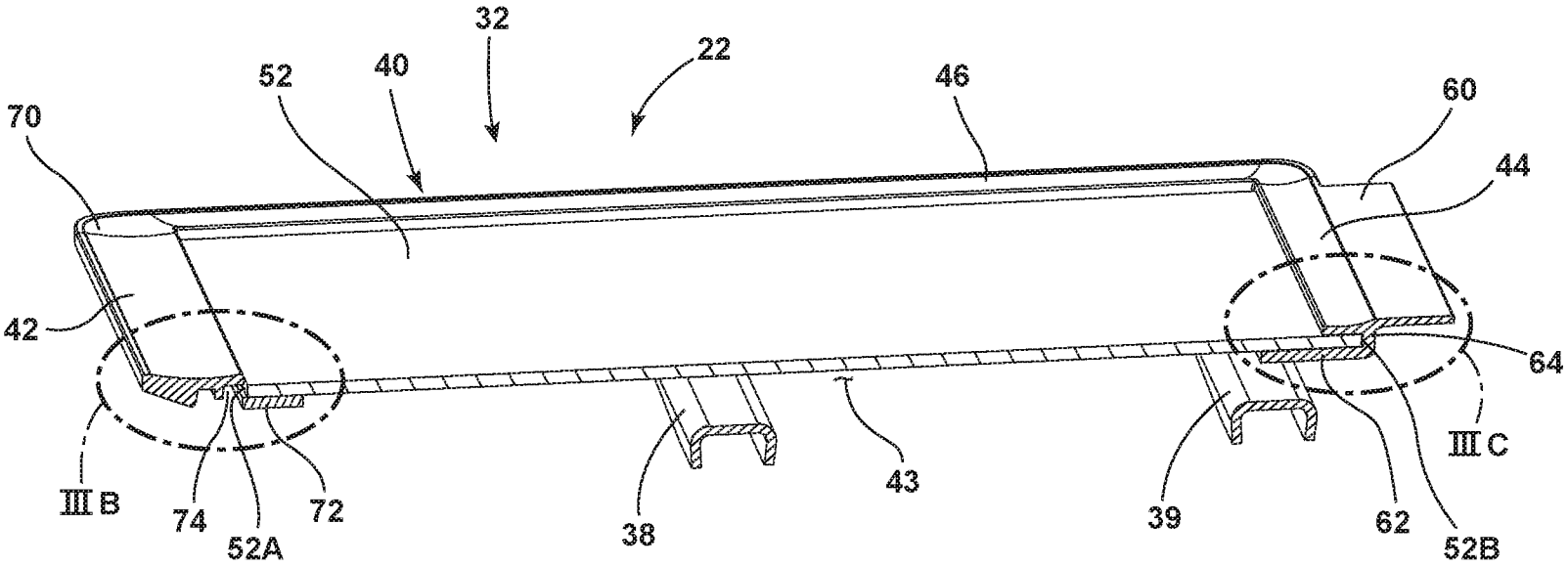
FIG. 3A is a cross-sectional top perspective view of the shelf assembly of FIG. 2 taken at line IIIA and showing a glass panel in a first position.

Referring now to FIG. 3A, a cross-sectional view of the shelf assembly 22 is shown specifically at the first side portion 32 thereof. The rear frame member 44 is shown having first and second portions 60, 62 which are vertically spaced-apart from one another to define a rear channel 64 therebetween. Similarly, the front frame member 42 is shown having first and second portions 70, 72 which are vertically spaced-apart from one another to define a front channel 74 therebetween. The glass panel 52 is shown being inserted into a receiving area 43 of the frame assembly 40 that is defined between the front and rear frame members 42, 44. A rear end 52B of the glass panel 52 is shown fully inserted into the rear channel 64 of the rear frame member 44. As rear end 52B of the glass panel 52 is inserted into the frame assembly 40 at rear channel 64, a front end 52A of the glass panel 52 is disposed above the front frame member 42. Thus, during this assembly step, the glass panel 52 is contemplated to be disposed at an angle of approximately 2° until the front end 52A of the glass panel 52 clears the front frame member 42. As further shown in FIG. 3A, the shelf assembly 22 is supported via first and second brackets 38, 39 from an underside thereof.

Figure 3C:
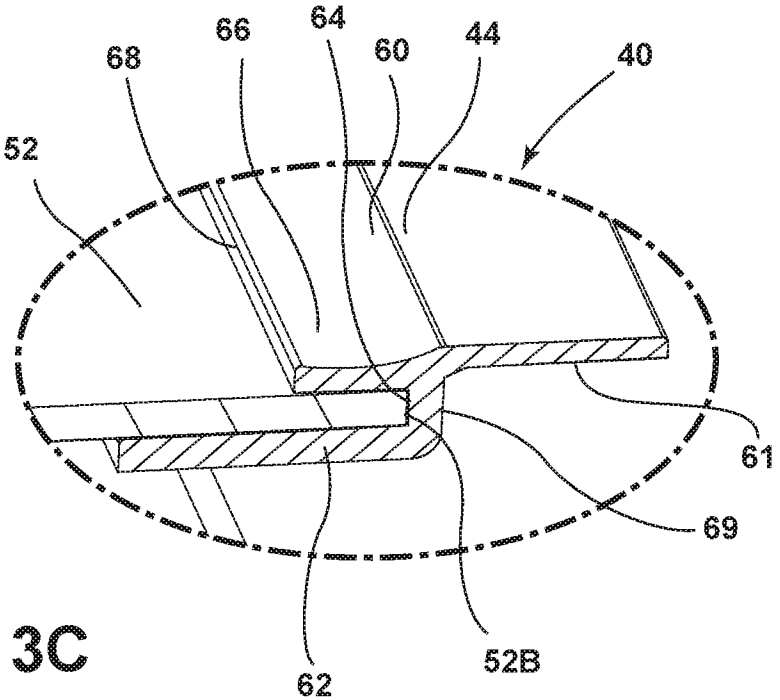
FIG. 3C is an enhanced view of the shelf assembly of FIG. 3A taken at location IIIC.
Figure 3B:
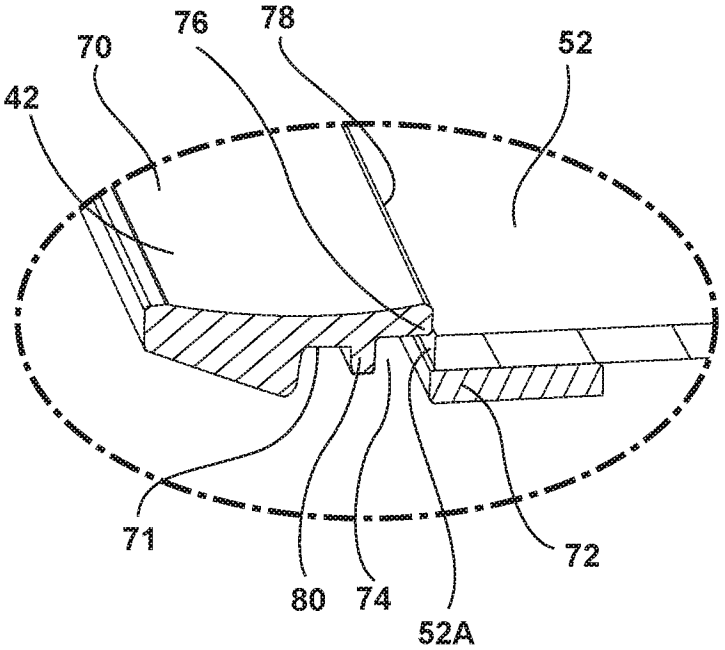
FIG. 3B is an enhanced view of the shelf assembly of FIG. 3A taken at location IIIB.

Referring now to FIG. 3B, the first portion 70 of the front frame member 42 is shown having an inside lip portion 76, having an innermost edge 78. In the assembly step depicted in FIG. 3B, the first end 52A of the glass panel 52 is shown to have cleared the innermost edge 78 of the inside lip portion 76 of the front frame member 42. Thus, in the position shown in FIG. 3B, the first end 52A of the glass panel 52 is positioned inwardly from the innermost edge 78 of the inside lip portion 76 of the front frame member 42. Due to this clearance position of the glass panel 52 relative to the innermost edge 78 of the inside lip portion 76 of the front frame member 42, the glass panel 52 has dropped downwardly at the first end 52A to be abuttingly supported on the second portion 72 of the front frame member 42. As further shown in FIG. 3B, the front channel 74 includes an end wall 80 which downwardly extends from an underside 71 of the first portion 70 of the front frame member 42. The movement of the first end 52A of the glass panel 52 to the abutting position on the second portion 72 of the front frame member 42 is provided by the second end 52B of the glass panel 52 being fully inserted into the rear channel 64 of the rear frame member 44 as further described below with reference to FIG. 3C.

Referring now to FIG. 3C, the first portion 60 of the rear frame member 44 is shown having an inside lip portion 66, having a distal end 68. In the assembly step depicted in FIG. 3C, the second end 52B of the glass panel 52 is shown having been fully received in the rear channel 64 of the rear frame member 44. The rearward sliding of the glass panel 52 into the rear channel 64 of the rear frame member 44 allows for movement of the first end 52A of the glass panel 52 to drop down to the abutting position on the second portion 72 of the front frame member 42, as shown in FIG. 3B. As further shown in FIG. 3C, the rear channel 64 includes an end wall 69 which downwardly extends from an underside 61 of the first portion 60 of the rear frame member 44 and interconnects the first portion 60 and the second portion 62 of the rear frame member 44. In the assembly step shown in FIG. 3C, the second end 52B of the glass panel 52 has been moved rearward into the rear channel 64 of the rear frame member 44 until the second end 52B engages the end wall 69 of the first portion 60 of the rear frame member 44. In this way, the end wall 69 acts as a stop feature for the movement of the glass panel 52 in a rearward direction within the rear channel 64 of the rear frame member 44 during assembly. Thus, in FIGS. 3A-3C, the glass panel 52 is shown in a first position within the receiving area 43, and is contemplated to slide forward to a second position within the receiving area 43, as further described below.

Figure 4A:
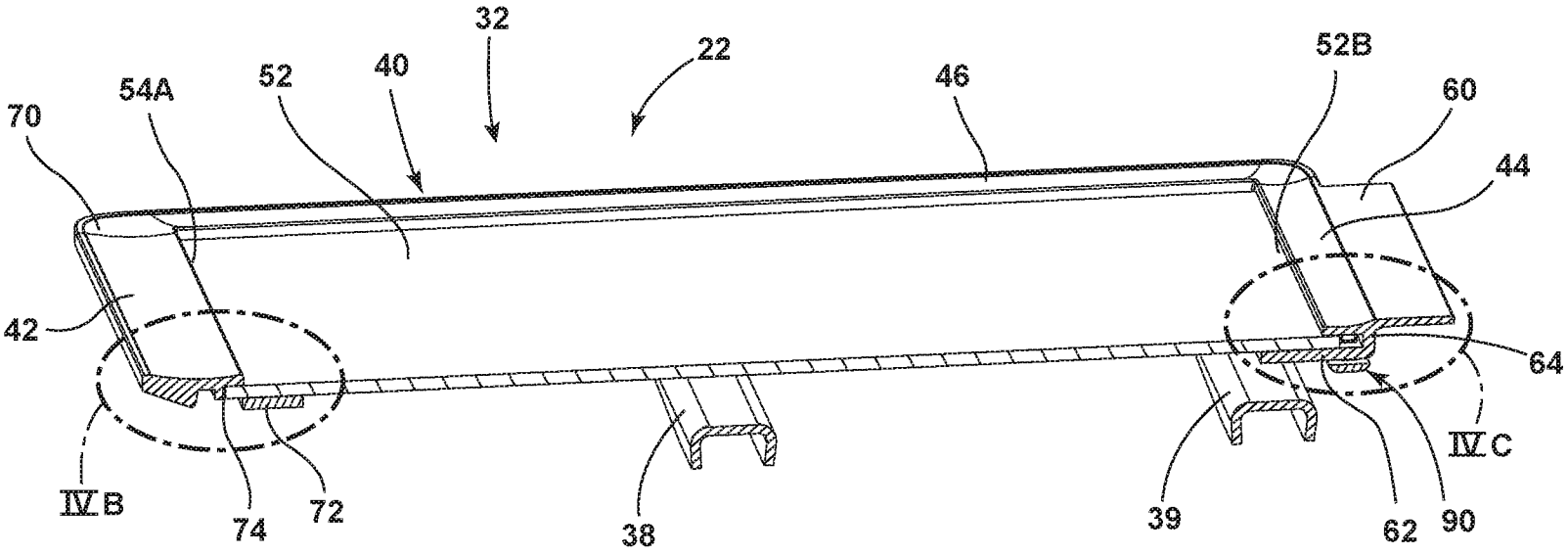
FIG. 4A is a top perspective view of the shelf assembly of FIG. 3A showing the glass panel in a second position.
Figure 4C:
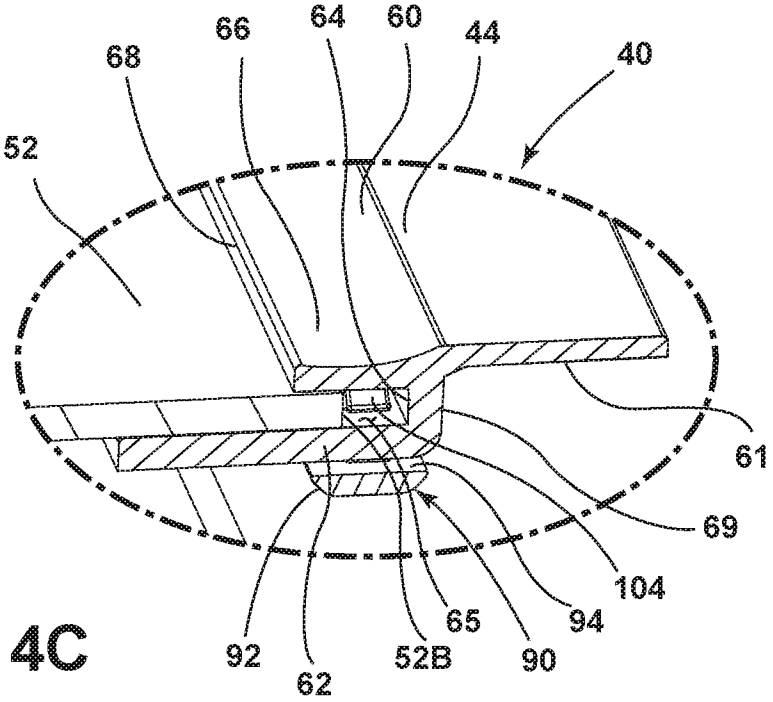
FIG. 4C is an enhanced view of the shelf assembly of FIG. 4A taken at location IVC.
Figure 4B:
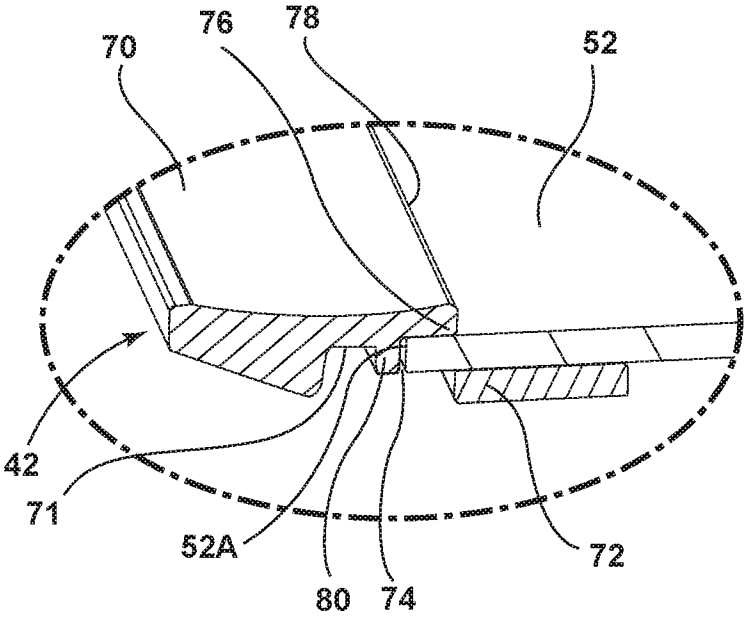
FIG. 4B is an enhanced view of the shelf assembly of FIG. 4A taken at location IVB.

Referring now to FIGS. 4A and 4B, an assembly step is depicted, wherein the first end 52A of the glass panel 52 is shown being fully received in the front channel 74 of the front frame member 42. In this way, the glass panel 52 is contemplated to have moved forward from the first position shown in FIG. 3C, wherein the second end 52B of the glass panel 52 is fully received within the rear channel 64 of the rear frame member 44, to a second position, wherein the first end 52A of the glass panel 52 is received in the front channel 74 of the front frame member 42. As further shown in FIG. 4B, the first end 52A of the glass panel 52 is shown abutting the end wall 80 of the first portion 70 of the front frame member 42. Thus, the first end 52A of the glass panel 52 is positively captured between the first and second portions 70, 72 of the front frame member 42 within the front channel 74.

Referring now to FIG. 4C, with the first end 52A of the glass panel 52 being fully received in the front channel 74 of the front frame member 42 (FIG. 4B) when the glass panel 52 is in the second position, the second end 52B of the glass panel 52 is shown having moved forward and away from the end wall 69 within the rear channel 64 of the rear frame member 44 (FIG. 4C). This forward movement provides for a spacing or gap 65 disposed within the rear channel 64 and defined between the second end 52B of the glass panel 52 and the end wall 69 of the rear frame member 44. Even with the glass panel 52 having been moved forward to the second position for full reception of the first end 52A thereof within the front channel 74 of the front frame member 42, the second end 52B of the glass panel 52 is still positively captured between the first and second portions 60, 62 of the rear frame member 44, such that the glass panel 52 in the assembly step depicted in FIGS. 4A-4C is fully retained at front and rear ends 52A, 52B thereof by the front and rear frame members 42, 44 at the front and rear channels 74, 64, thereof.

Figure 5:
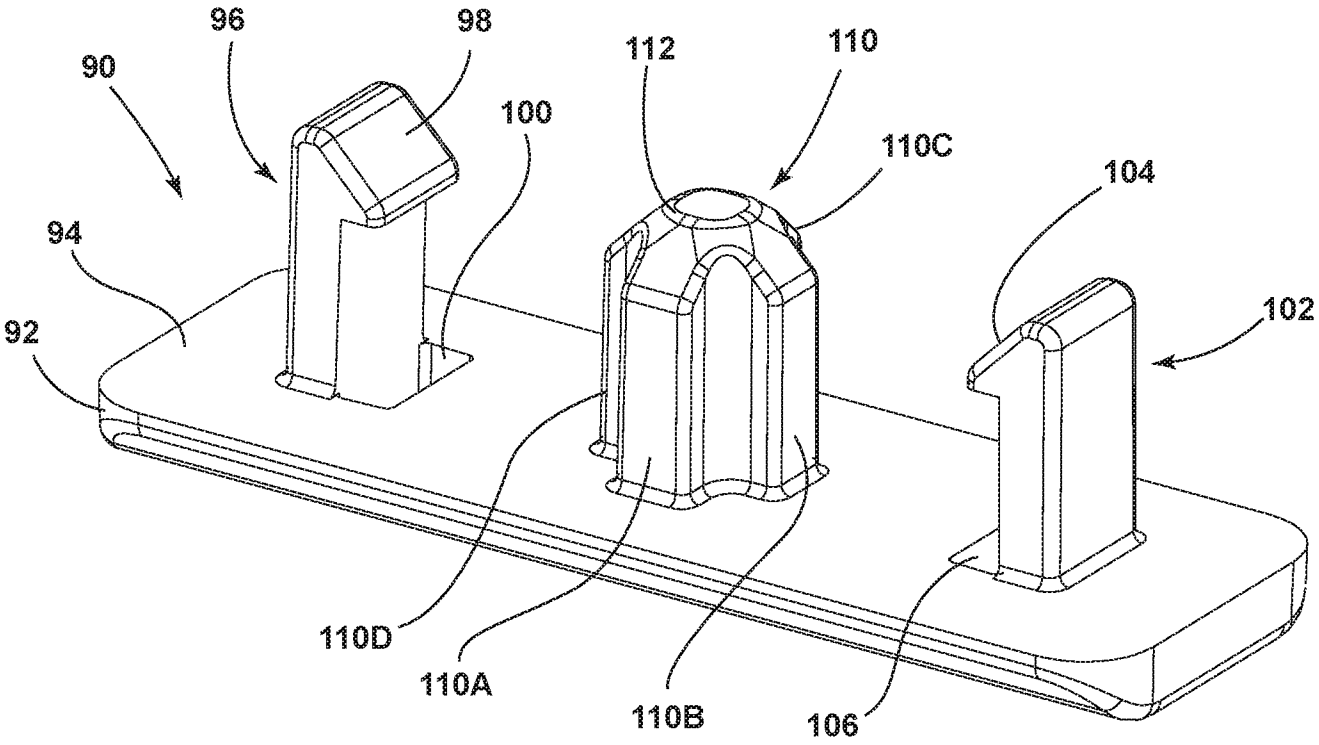
FIG. 5 is a top perspective view of a spacer assembly.

Referring now to FIG. 5, a spacer assembly 90 is shown having a base portion 92 with an upper surface 94. Extending upwardly from the upper surface 94, a first clip member 96 is shown having an engagement end 98. The first clip member 96 is disposed adjacent to an aperture 100 disposed through the base portion 92, such that the first clip member 96 is contemplated to be a flexibly resilient member configured to couple to a portion of the frame assembly 40 in a snap-fit manner, as further described below. As further shown in FIG. 5, a second clip member 102 is also shown extending upwardly from the upper surface 94 of the base portion 92, wherein the second clip member 102 is shown having an engagement end 104. The second clip member 102 is disposed adjacent to an aperture 106 disposed through the base portion 92, such that the second clip member 102 is contemplated to be a flexibly resilient member configured to couple to a portion of the frame assembly 40 in a snap-fit manner, as shown in FIGS. 4A and 4C and further described below. As further shown in FIG. 5, a spacer member 110 is shown upwardly extending from the upper surface 94 of the base portion 92 and includes a cross-shaped cross-section made up of four arms 110A-110D. The four arms 110A-110D of the spacer member 110 culminate in a tapered tip portion 112 of the spacer member 110. The four arms 110A-110D include a front arm 110A, a rear arm 110C, a first side arm 110B and a second side arm 110D. In use, the spacer member 110 helps to retain a glass panel, such as glass panel 52, in a retained position when the cross-shaped spacer member 110 is received in a cross-shaped receiving aperture of the rear frame member 44, as further described below. As further shown in FIG. 5, the spacer assembly 110 is non-directional, such that front arm 110A, can be the rear arm 110C when the spacer assembly 110 is turned around from the orientation illustrated in FIG. 5. In this way, the spacer assembly 110 can be easily inserted into an engaged relationship with the rear frame member 44 regardless of the orientation of the spacer assembly 110 for easy assembly.

Figure 6A:
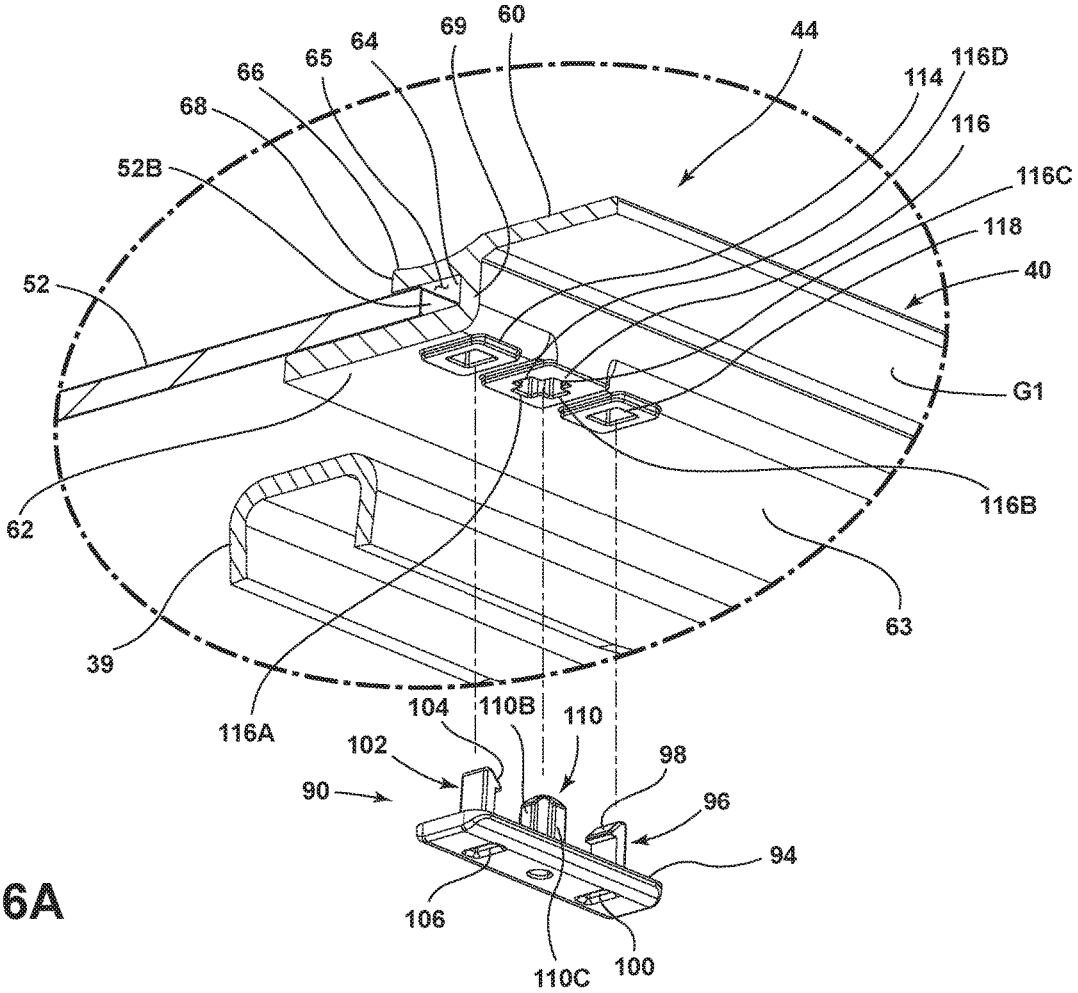
FIG. 6A is a bottom perspective view of the shelf assembly of FIG. 4C showing the spacer assembly of FIG. 5 exploded away therefrom.

Referring now to FIG. 6A, in order to keep the first and second ends 52A, 52B of the glass panel 52 retained in the respective front and rear channels 74, 64 of the frame assembly 40, the spacer assembly 90 must be secured to the rear frame member 44. As noted above, with the glass panel 52 having been moved forward for full reception of the first end 52A thereof within the front channel 74 of the front frame member 42, the second end 52B of the glass panel 52 is spaced-apart from the end wall 69 of the rear channel 64 to provide the gap 65 defined between the second end 52B of the glass panel 52 and the end wall 69. In FIG. 6A, the spacer assembly 90 is shown exploded away from an underside 63 of the second portion 62 of the rear frame member 44. The second portion 62 of the rear frame member 44 includes mounting apertures 114, 118, disposed on either side of a receiving aperture 116. The mounting apertures 114, 118 are configured to receive the first and second clip members 96, 102, respectively, therethrough to clip and secure the spacer assembly 90 on the second portion 62 of the rear frame member 44. The spacer member 110 extends through the receiving aperture 116 into the rear channel 64 to engage the second end 52B of the glass panel 52 within the rear channel 64 to secure and retain the glass panel 52 in the full forward position. The tapered distal end 112 of the spacer member 110 helps to urge the glass panel 52 towards the full forward second position as the spacer assembly 90 is clipped to the second portion 62 of the rear frame member 44. As further shown in FIG. 6A, the receiving aperture 116 is a cross-shaped receiving aperture having a plurality of outwardly extending segments 116A-116D. In assembly, the four arms 110A-110D of the spacer member 110 are configured to be received in the cross-shaped receiving aperture 116 at the outwardly extending segments 116A-116D thereof, respectively. This connection of the spacer assembly 90 to the rear frame member 44 retains the glass panel 52 in the second position when the cross-shaped spacer member 110 is received in a cross-shaped receiving aperture 116 of the rear frame member 44.

Figure 6B:
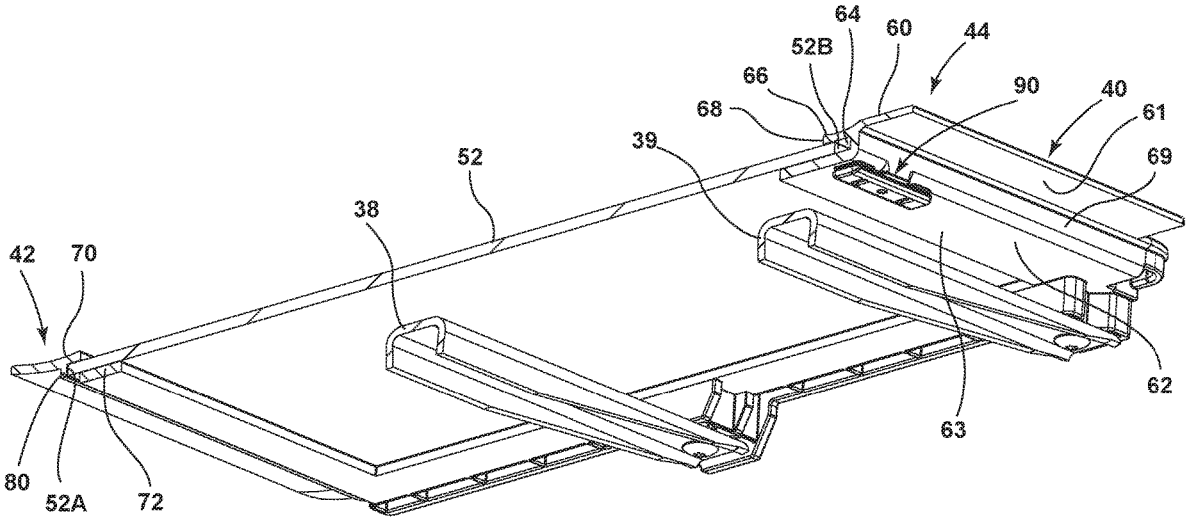
FIG. 6B is a bottom perspective view of the shelf assembly of FIG. 6A showing the spacer assembly coupled to the frame assembly.

Referring now to FIG. 6B, the spacer assembly 90 is shown secured on the second portion 62 of the rear frame member 44, such that the glass panel 52 is positively captured therein and retained against fore and aft movement as retained therein. Removal of the glass panel 52 requires removal of the spacer assembly 90. While the embodiment shown in FIG. 6B shows a single spacer assembly 90 coupled to the second portion 62 of the rear frame member 44, it is contemplated that any number of spacer assemblies can be clipped thereto to evenly distribute the retaining of the glass panel 52 within the frame assembly 40.

Figure 6C:
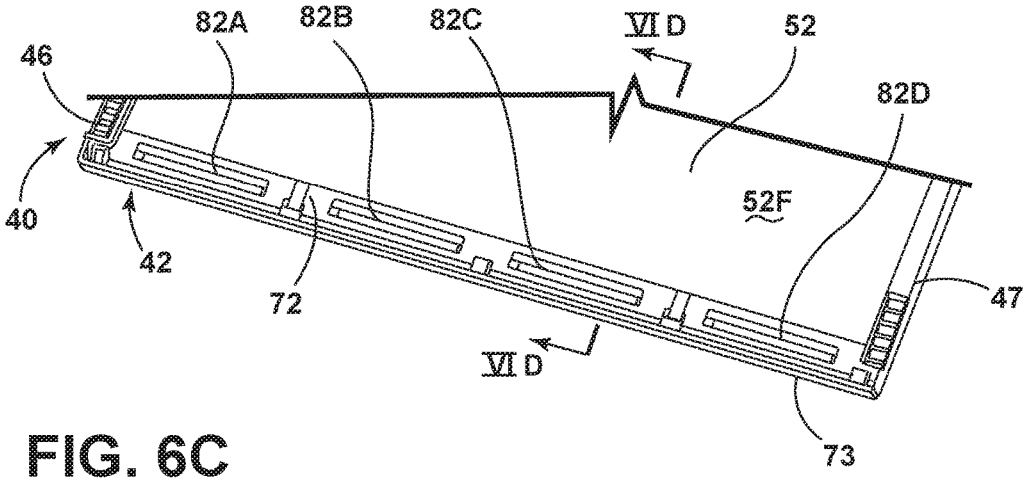
FIG. 6C is a bottom perspective view of a portion of the shelf assembly of FIG. 6A.
Figure 6D:
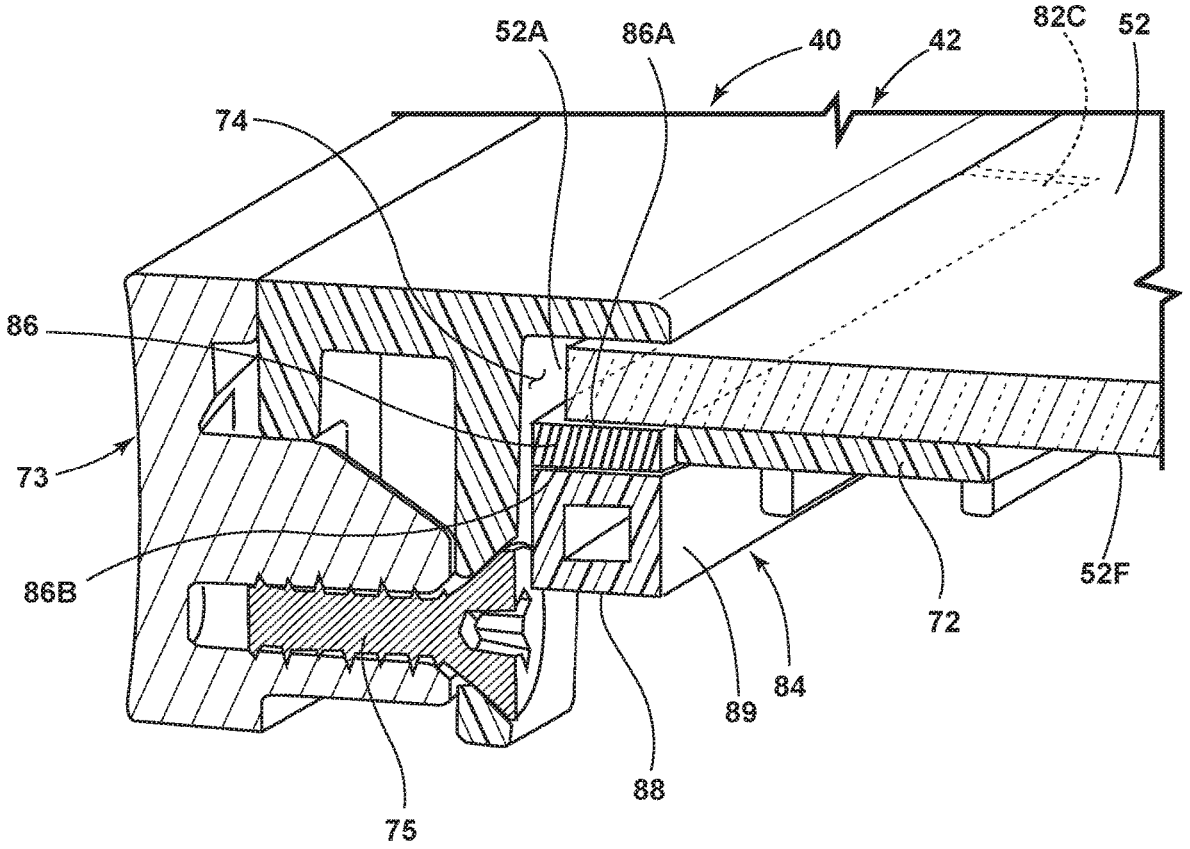
FIG. 6D is a cross sectional view of the shelf assembly of FIG. 6C taken at line VID.

Referring now to FIG. 6C, the front frame member 42 of the frame assembly 40 is shown having a plurality of apertures 82A-82D that are elongate apertures that are serially aligned with one another and disposed through the second portion 72 of the front frame member 42. The apertures 82A-82D provide access to an underside 52F of the glass panel 52 when the glass panel 52 is in the second position, wherein the first end 52A of the glass panel 52 is fully received in the front channel 74 of the front frame member 42 as shown in FIG. 6D. With the glass panel 52 positioned in the second position, individual retainer assemblies 84 can be inserted into each of the apertures 82A-82D. With specific reference to FIG. 6D, the retainer assemblies 84 include an adhesive member 86 having first and second adhesive layers 86A, 86B, much like a double-sided tape segment. In FIG. 6D, a retainer assembly 84 is positioned in aperture 82C of the frame assembly 40. The retainer assembly 84 is retained in this position by adhering the first adhesive layer 86A to the underside 52F of the glass panel 52 through aperture 82C. A retainer member 88 is coupled to the second adhesive layer 86B of the adhesive member 86. With the retainer member 88 protruding downward from the underside 52F of the glass panel 52 through the aperture 82C, the glass panel 52 is further retained in the second position from undesired lateral shifting within the frame assembly 40. It is contemplated that a separate retainer assembly 84 is received in each aperture 82A-82D disposed through the second portion 72 of the front frame member 42. Further, it is contemplated that similar apertures can be disposed on opposing side frame members 46, 47 of the peripheral frame assembly 40 to further retain the glass panel 52 in place. The retainer member 88 is contemplated to be a foam member that is sized to be closely received within the apertures 82A-82D, such that an outer surface 89 of the retainer member 88 abuttingly engages the parameters of the aperture in which it is disposed. As further shown in FIG. 6D, a front trim member 73 is coupled to the front frame member 42 via a fastener 75.

In the embodiment shown in FIGS. 1-6D, the shelf assembly 22 includes front and rear frame members 42, 44 of the frame assembly 40. The designations of "front" and "rear" as used herein with respect to the front and rear frame members 42, 44 is for identification purposes only for the accompanying drawings. The "front" and "rear" designations do not specify specific orientations, but rather distinguish one frame member from the other. Thus, as used herein, as well as in the claims, the terms "front" and "rear" are not specific positional identifiers, but are used to distinguish opposing frame members. As such, the glass panel 52 may move reward from a first position, wherein the first end 52A of the glass panel 52 is fully received within the front channel 74 of the front frame member 42, to a second position, wherein the second end 52B of the glass panel 52 is fully received in the rear channel 64 of the rear frame member 44. In this configuration, the spacer assembly 90 would be received in the front channel 74 of the front frame member 42.

Figure 7A:
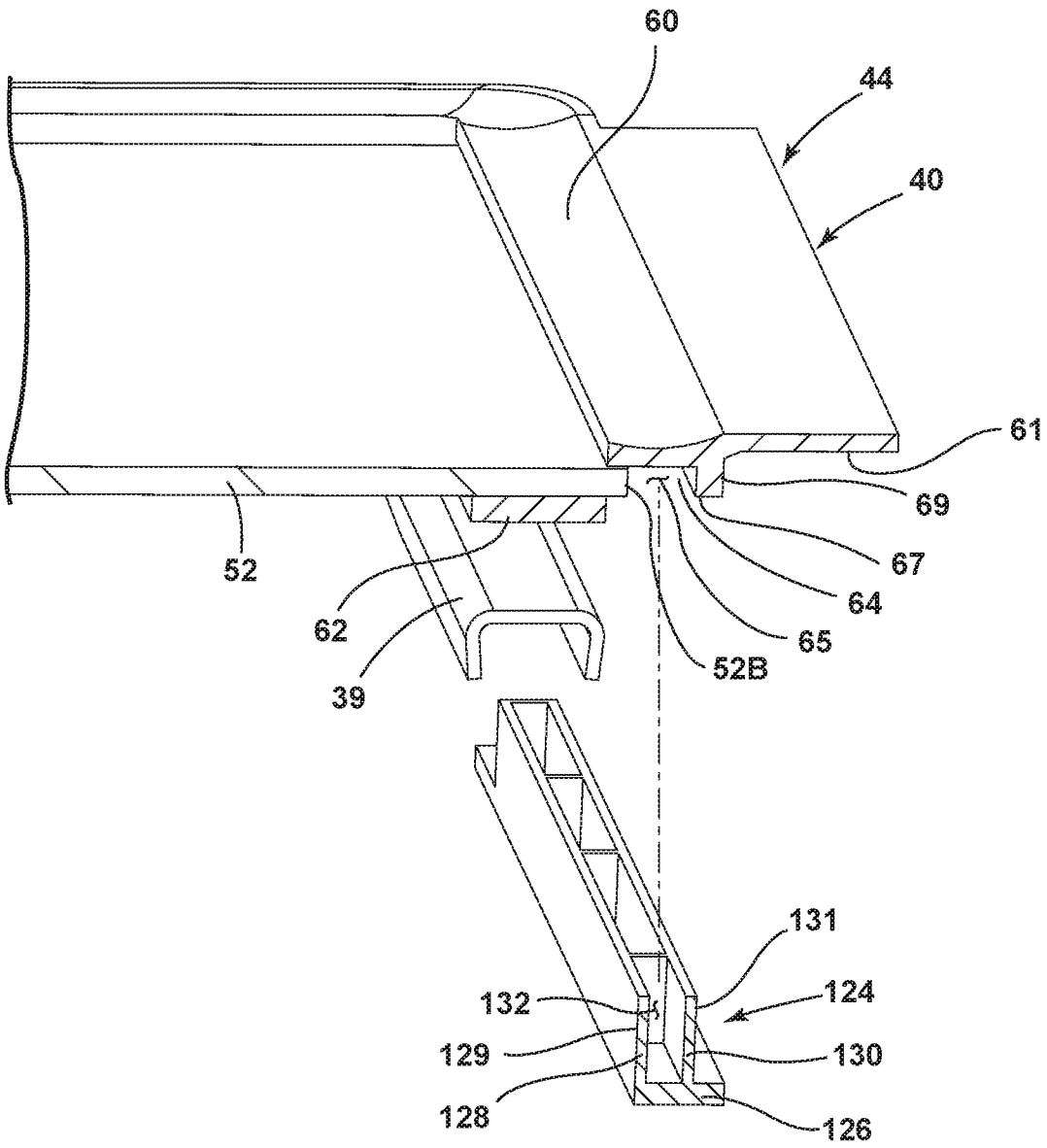
FIG. 7A is a bottom perspective view of a shelf assembly according to another embodiment showing a spacer assembly exploded away therefrom.

Referring now to FIG. 7A, another embodiment of the frame assembly 40 is shown. Specifically, the rear frame member 44 includes first and second portions 60, 62 that are spaced-apart from each other with channel 64 disposed therebetween. In FIG. 7A, end wall 69 extends downwardly from the underside 61 of first portion 60, but does not interconnect the first and second portions 60, 62 in a manner as shown in the embodiment of FIG. 4C. Instead, an access slot 67 is provided into channel 64 from an underside thereof. As further shown in FIG. 7A, the second end 52B of the glass panel 52 is spaced-apart from the end wall 69 of the rear channel 64 to define the gap 65 between the second end 52B of the glass panel 52 and the end wall 69. A spacer assembly 124 is shown exploded away from the rear channel 64 and is configured for reception therein to retain the gap 65 between the second end 52B of the glass panel 52 and the end wall 69. With the gap 65 filled by the spacer assembly 124, the glass panel 52 will remain positively captured between the first and second portions 60, 62 of the rear frame member 44 at the second end 52B of the glass panel 52, and will also be positively retained at the first end 52A of the glass panel 52 between the first and second portions 70, 72 of the front frame member 42 in a similar manner as shown in FIG. 4B. As shown in FIG. 7A, the spacer assembly 124 includes a base portion 126 having first and second retaining arms 128, 130 outwardly extending therefrom. The first and second retaining arms 128, 130 are spaced-apart from one another to define a fastening channel 132 therebetween. In assembly, an outer surface 129 of the first retaining arm 128 engages the second end 52B of the glass panel 52 to keep the glass panel 52 from moving between fore and aft positions within the frame assembly 40. Further, an outer surface 131 of the second retaining arm 130 engages the end wall 69 of the first portion 60 within rear channel 64 to keep the glass panel 52 from moving between fore and aft positions within the frame assembly 40. The first and second retaining arms 128, 130 are contemplated to run the length of the channel 64 of the rear frame member 44, such that the spacer assembly 124 evenly distributes a retaining feature for the second end 52B of the glass panel 52 as captured between the front and rear frame members 42, 44.

Figure 7B:
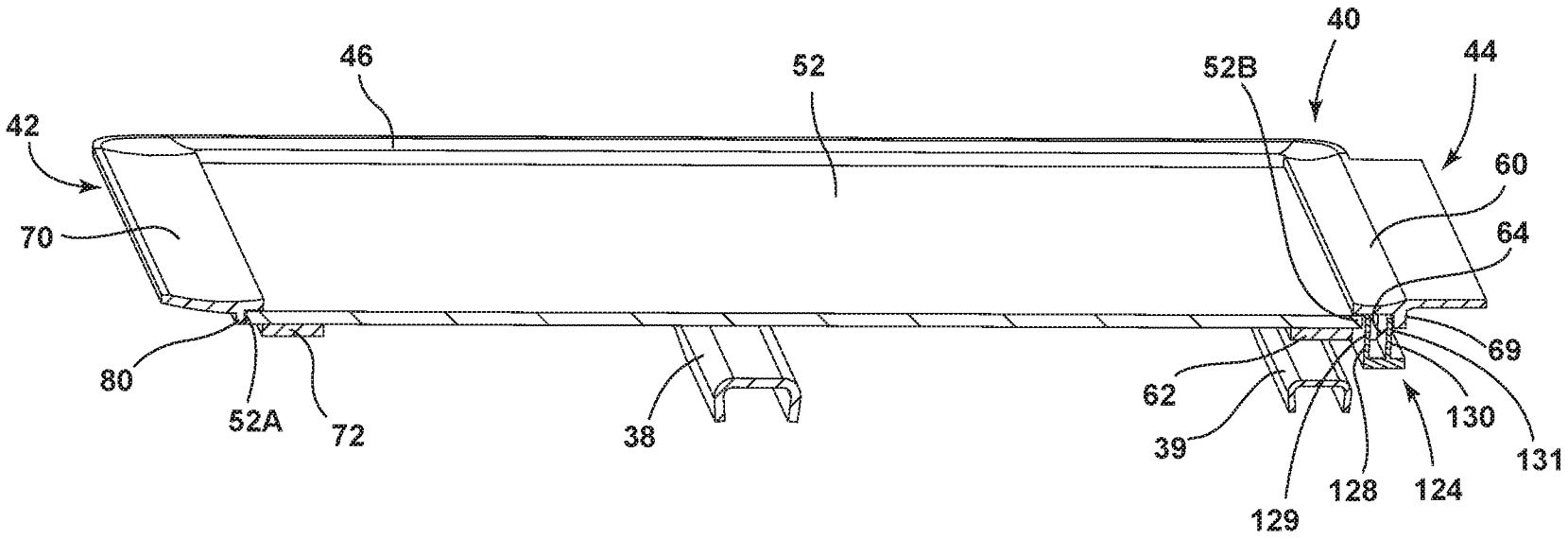
FIG. 7B is a bottom perspective view of the shelf assembly of FIG. 7A showing the spacer assembly coupled to the frame assembly.
Figure 8:
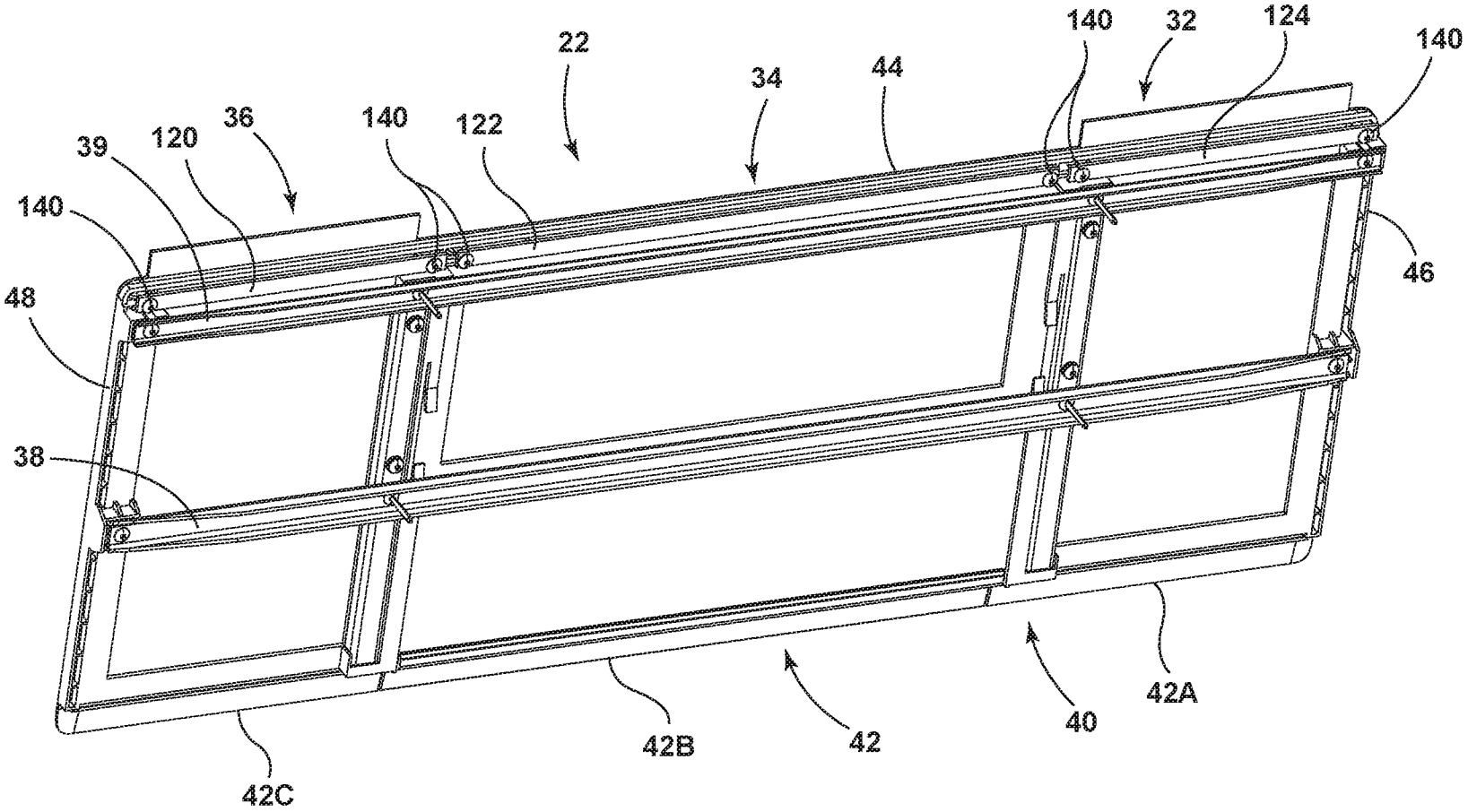
FIG. 8 is a bottom perspective view of the shelf assembly of FIG. 7A with multiple spacer assemblies coupled thereto along a length thereof.

Referring now to FIG. 7B, the spacer assembly 124 is shown coupled to the rear frame member 44 as received within the rear channel 64 thereof. As shown in FIG. 7B, the first and second retaining arms 128, 130 are engaged with the second end 52B of the glass panel 52 and the end wall 69 of the rear frame member 44 at outer surfaces 129, 131 thereof, respectively. As shown in FIG. 8, the shelf assembly 22 may include a number of spacer assemblies 120, 122 and 124 for coupling to the rear frame member 44 at the channel 64 thereof. It is contemplated that the spacer assemblies 120, 122 are similar in configuration to the spacer assembly 124 described above. As shown in FIG. 8, the spacer assemblies 120, 122 and 124 are coupled to the rear frame member 44 via fasteners 140, which are contemplated to be received through the base portion 126 (FIG. 7A) of each spacer assembly 120, 122 and 124 and into the fastening channel 132 of the spacer assemblies 120, 122 and 124. It is further contemplated that the rear frame member 44 may include mounting bosses disposed within the rear channel 64 thereof which downwardly extend from an underside of the rear frame member 44 for receiving the fasteners 140 therein to secure the spacer assemblies 120, 122 and 124 within the rear channel 64.

Figure 9A:
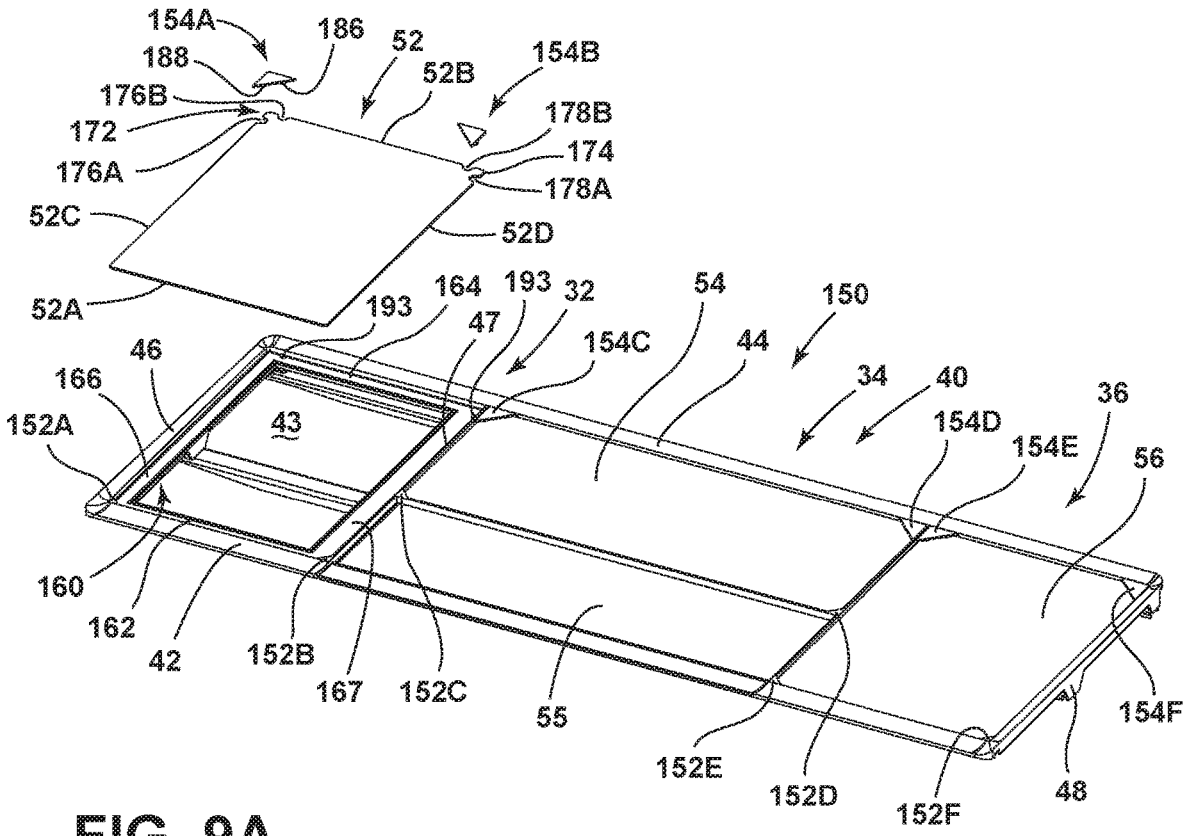
FIG. 9A is a top perspective view of a shelf assembly according to another embodiment with a glass panel and retaining members exploded away from a frame assembly.

Referring now to FIG. 9A, a glass shelf assembly 150 is shown according to another embodiment. The glass shelf assembly 150 includes first and second side portions 32, 36 with an intermediate portion 34 disposed therebetween, much like the glass shelf assembly 22 described above with reference to FIG. 2. The glass shelf assembly 150 includes front and rear frame members 42, 44, and opposing side frame members 46, 48 which are interconnected to define a peripheral frame assembly 40. The peripheral frame assembly 40 is contemplated to be comprised of a molded plastic material that is adapted to receive one or more glass panels during an assembly of the shelf assembly 150. In the embodiment shown in FIG. 9A, a plurality of glass panels are shown supported by the peripheral frame assembly 40 and are identified as glass panels 52, 54 and 56, which coincide with the first side portion 32, the intermediate portion 34, and the second side portion 36, respectively. The intermediate portion 34 further includes an adjustable glass panel 55 which is contemplated to be adjustable between retracted and deployed positions. The glass panel 52 is shown exploded away from a receiving area 43 defined between the front and rear frame members 42, 44 of the frame assembly 40. Insertion of the glass panel 52 into the receiving area 43 is further described below with reference to FIGS. 10A-11B.

Figure 9B:
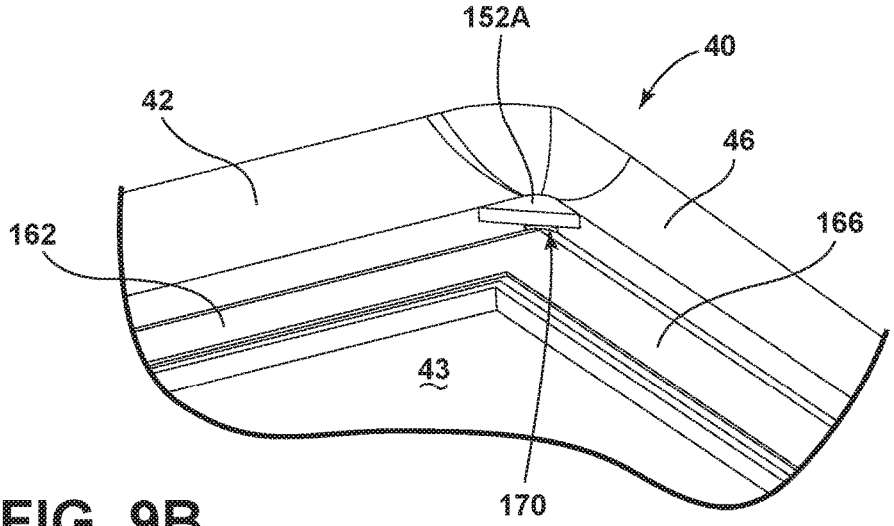
FIG. 9B is an enhanced view of the shelf assembly of FIG. 9A at a front corner thereof.

As further shown in FIG. 9A, the first side portion 32 includes front and rear frame members 42, 44 which are interconnected by opposing side frame members 46, 47 to define a peripheral frame assembly 40A that is a subset of frame assembly 40. A support ledge 160 is shown having front and rear portions 162, 164 that are interconnected by side portions 166, 167. The support ledge 160 is inset from and surrounded by the front and rear frame members 42, 44 and the side frame members 46, 47 of the peripheral frame assembly 40A. Specifically, the front and rear portions 162, 164 of the support ledge 160 extend inwardly into the receiving area 43 from the front and rear frame members 42, 44 of the peripheral frame assembly 40A. Further, the side portions 166, 167 of the support ledge 160 extend inwardly into the receiving area 43 from the opposing side frame members 46, 47 of the peripheral frame assembly 40A. Retaining tabs 152A-152F are shown disposed on the frame assembly 40. With specific reference to the peripheral frame assembly 40A, retaining tabs 152A and 152B are shown disposed on the front frame member 42 on opposite sides thereof. Thus, the retaining tabs 152A and 152B are positioned at the intersection of the front frame member 42 and the opposing side frame members 46, 47 and are spaced vertically above the support ledge 162 define a slot therebetween. The slot defined between retaining tab 152A and the front and side portions 162, 166 of the support ledge 160 is identified as reference numeral 170 in FIG. 9B. The glass panel 52 shown in FIG. 9A includes front and rear ends 52A, 52B and opposing sides 52C, 52D. Opposite sides of the front end 52A are configured to be received under the retaining tabs 152A, 152B in assembly, as further described below. Thus, a portion of the front end 52A is received in slot 170 defined between retaining tab 152A and the front and side portions 162, 166 of the support ledge 160 in assembly to retain the glass panel 52 in place.

As further shown in FIG. 9A, the glass panel 52 includes tabs 172, 174 disposed on opposite corners of the rear end 52B of the glass panel 52. The tabs 172, 174 are generally defined between recesses 176A, 176B and 178A, 178B respectively. In assembly, retaining members 154A, 154B are used to retain the glass panel 52 in the receiving area 43 by covering tabs 172, 174, as further described below. In the embodiment of FIG. 9A, the frame assembly 40 includes a plurality of retaining members 154A-154F that are removably coupled to the frame assembly 42 retain the glass panels 52, 54 and 56 therein.

Figure 10A:
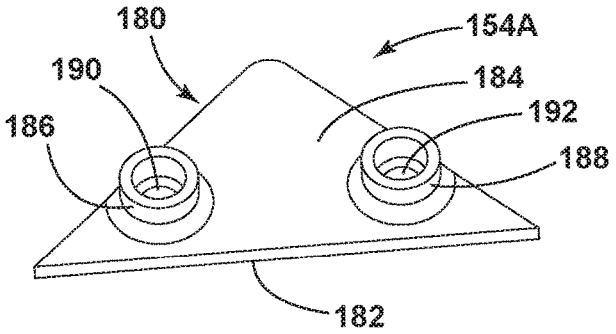
FIG. 10A is a bottom perspective view of a retaining member for FIG. 9A.
Figure 10B:
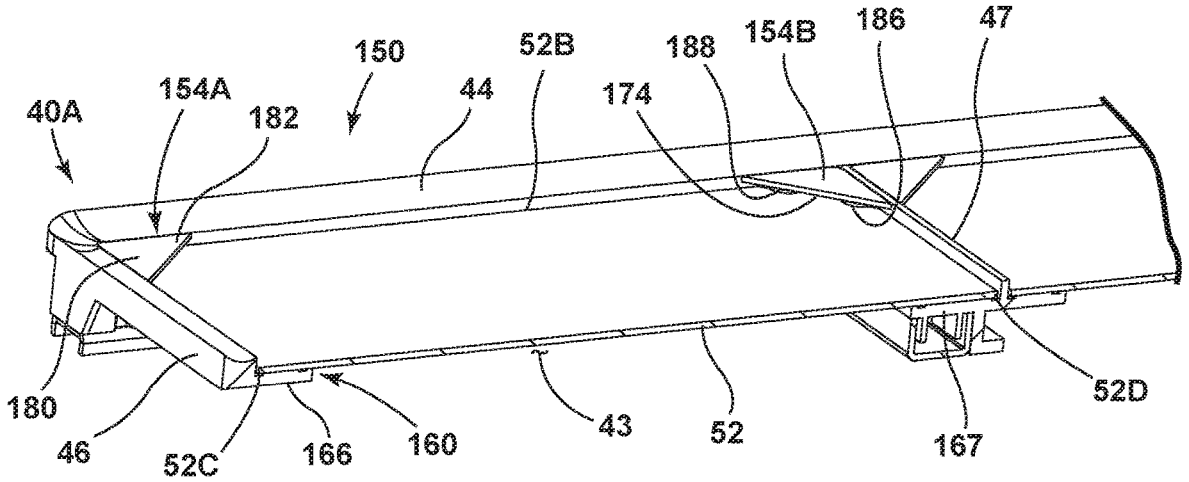
FIG. 10B is a cross-sectional top perspective view of the shelf assembly of FIG. 9A with the glass panel and retaining members coupled to the frame assembly.
Figure 10C:
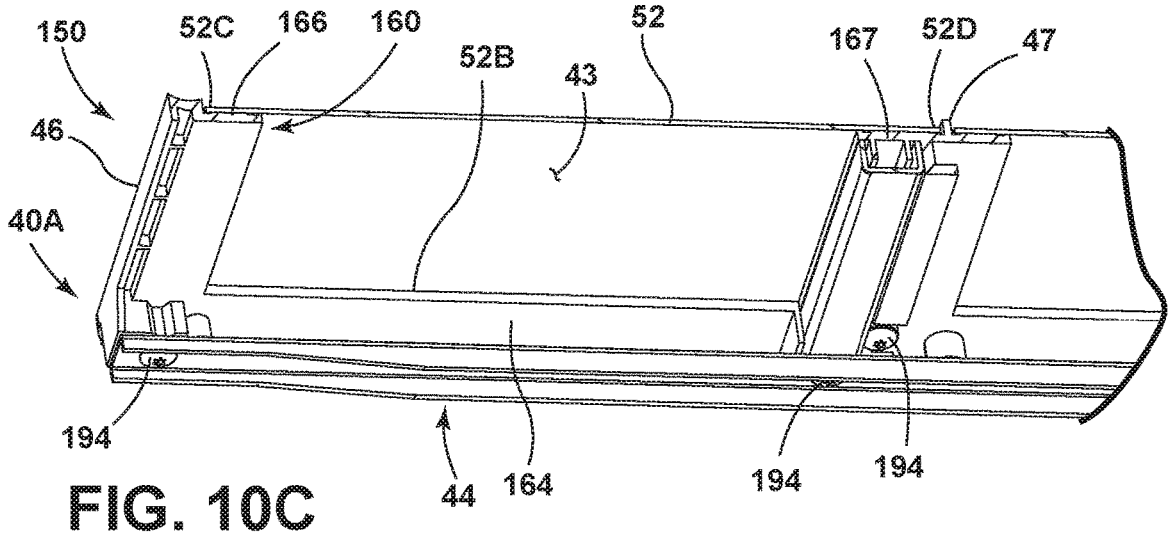
FIG. 10C is a cross-sectional bottom perspective view of the shelf assembly of FIG. 10B.
Figure 11A:
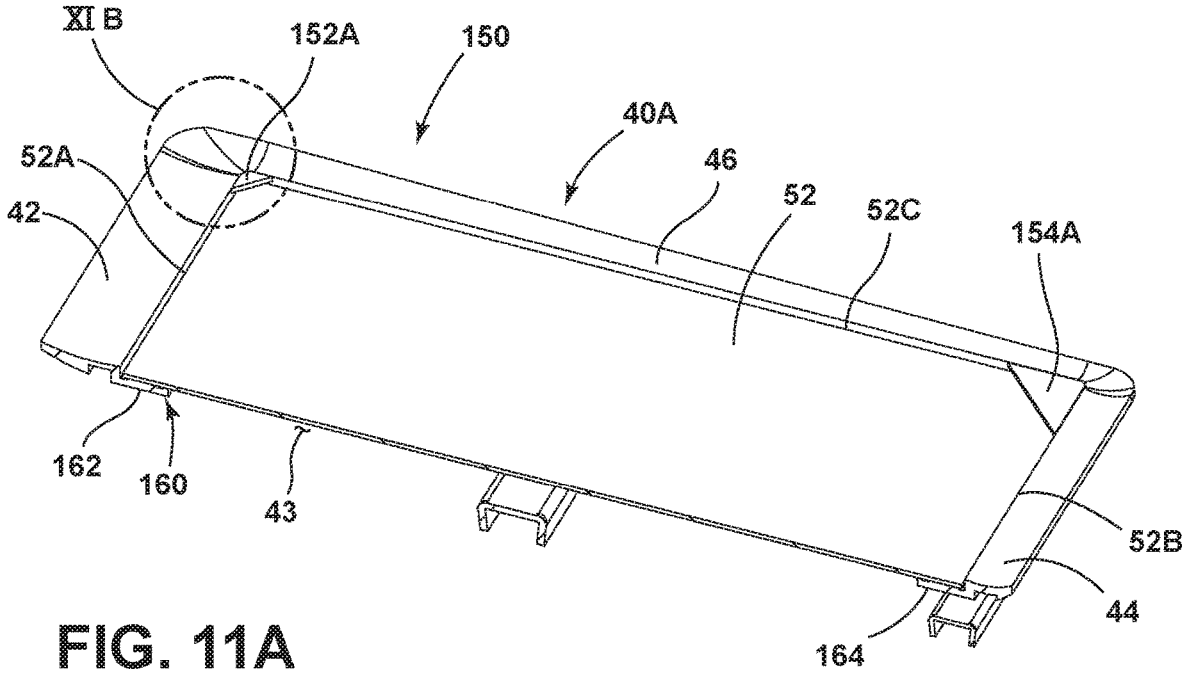
FIG. 11A is a cross-sectional top perspective view of the shelf assembly of FIG. 10B.
Figure 11B:
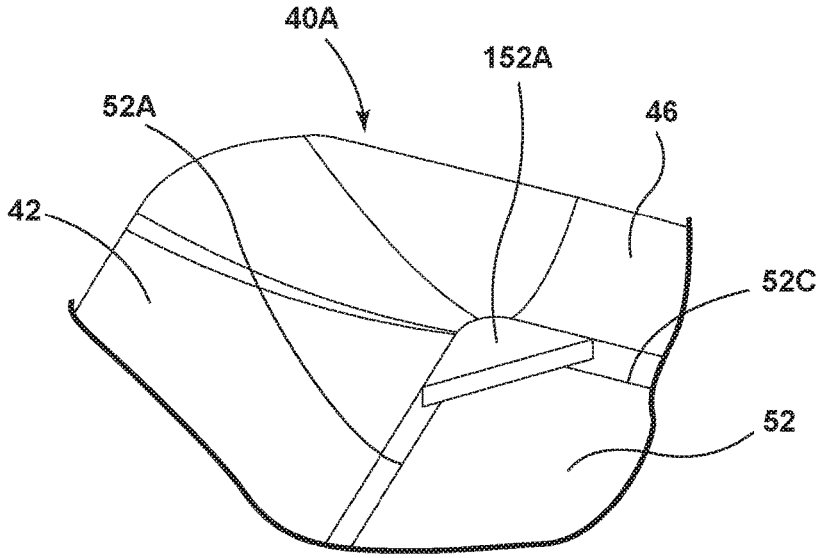
FIG. 11B is an enhanced view of the shelf assembly of FIG. 11A at a front corner thereof.

Referring now to FIG. 10A, retaining member 154A is shown from a bottom perspective view and is contemplated to have an identical configuration to retaining members 154B-154E, such that the description of retaining member 154A will be applicable to retaining members 154B-154E. As shown, the retaining member 154A includes a generally planar body portion 180 that has a triangular configuration in the embodiment shown in FIG. 10A. The body portion 180 includes upper and lower surfaces 182, 184. The lower surface 184 includes first and second mounting bosses 186, 188 having respective channels 190, 192 disposed therein. In assembly, the mounting bosses 186, 188 are configured to be received in the recesses of the glass panel 52. Specifically, and with reference to FIG. 9A, the mounting bosses 188, 186 are configured to be received in respective recesses 176A, 176B of the glass panel 52 on either side of tab 172. In this way, tab 172 is retained between the mounting bosses 188, 186 of the retaining member 154A in assembly. In FIG. 10B, retaining members 154A, 154B are shown disposed on opposite sides of the rear end 52B of the glass panel 52 to retain the glass panel 52 in the receiving area 43 as supported on the support ledge 160. Thus, in assembly, the front end 52A of the glass panel 52 is supported on the front portion 162 of the support ledge 160 with corners thereof disposed in slot 170 (FIG. 9B) below retaining tabs 152A, 152B, as best shown in FIGS. 11A, 11B. Once the front end 52A of the glass panel 52 is positioned below retaining tabs 152A, 152B, the rear end 52B of the glass panel 52 is rotated downward to rest on the rear portion 164 of the support ledge 160. Thus, the front end 52A of the glass panel 52 is supported on the front portion 162 of the support ledge 160, in assembly (FIG. 11A). The opposing sides 52C, 52D of the glass panel 52 are supported on the side portions 166, 167 of the support ledge 160, in assembly (FIG. 10B). The rear end 52B of the glass panel 52 is supported on the rear portion 164 of the support ledge 160, in assembly (FIG. 11A). In the embodiment shown in FIG. 10C, the retaining members 154A, 154B are shown retained on the frame assembly 40A by fasteners 194. The fasteners 194 are configured to be received in the channels 190, 192 of the mounting bosses 186, 188 of the retaining members 154A, 154B. Further, the fasteners 194 are contemplated to be received through mounting apertures 193 disposed in the support ledge 160 as shown in FIG. 9A. It is contemplated that one or both of the mounting bosses 186, 188 of the retaining members 154A, 154B can receive a fastener 194. In this way, the glass panel 52 is mechanically coupled to the frame assembly 40A, and positively retained by the retaining members 154A, 154B and the retaining tabs 152A, 152B, in assembly.

Figure 12A:
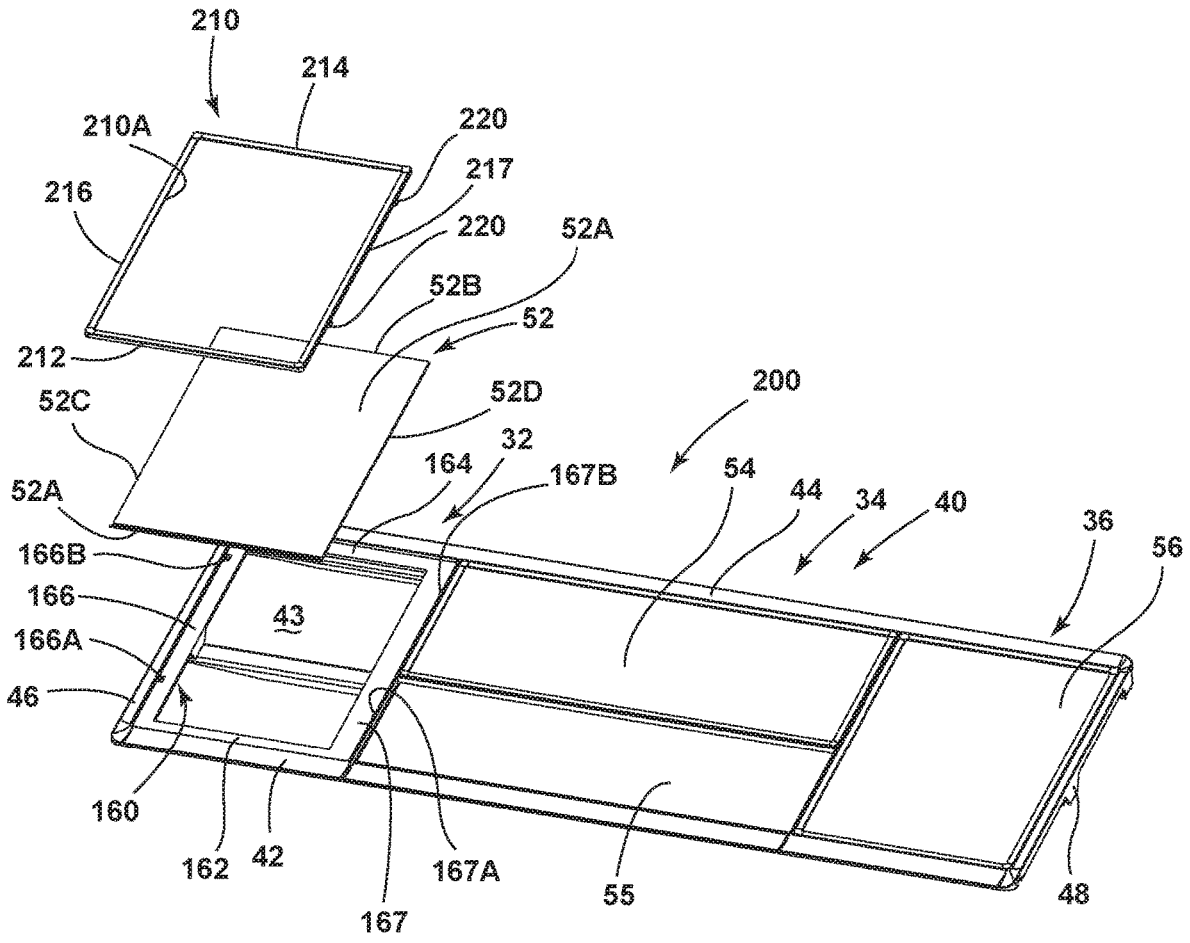
FIG. 12A is a top perspective view of a shelf assembly according to another embodiment with a glass panel and retaining frame exploded away from a frame assembly.

Referring now to FIG. 12A, a glass shelf assembly 200 is shown according to another embodiment. The glass shelf assembly 200 includes first and second side portions 32, 36 with an intermediate portion 34 disposed therebetween, much like the glass shelf assembly 150 described above with reference to FIG. 9A. The glass shelf assembly 200 includes front and rear frame members 42, 44, and opposing side frame members 46, 48 which are interconnected to define a peripheral frame assembly 40. A plurality of glass panels are shown supported by the peripheral frame assembly 40 and are identified as glass panels 52, 54 and 56, which coincide with the first side portion 32, the intermediate portion 34, and the second side portion 36, respectively. The glass panel 52 is shown exploded away from a receiving area 43 defined between the front and rear frame members 42, 44 of the frame assembly 40. Insertion of the glass panel 52 into the receiving area 43 is further described below with reference to FIGS. 12B and 13.

Figure 12B:
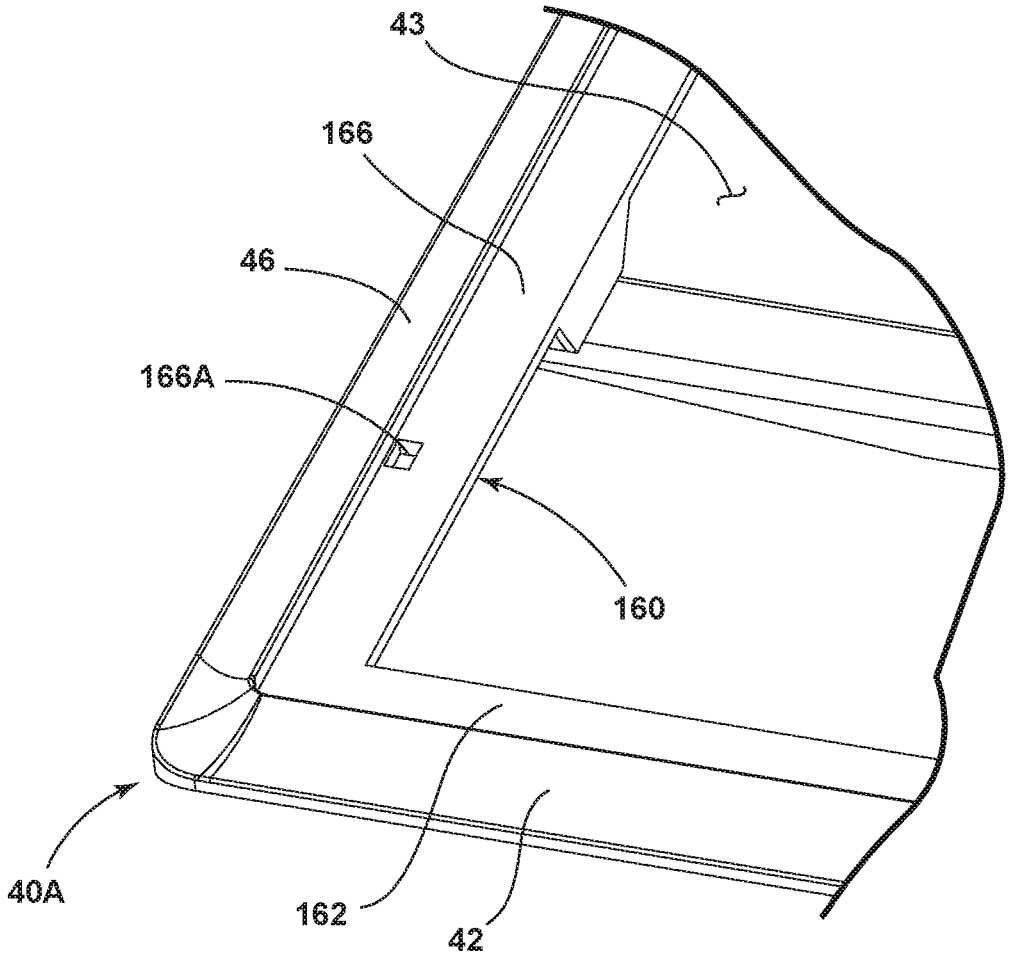
FIG. 12B is an enhanced view of the frame assembly of FIG. 12A at a front corner thereof.
Figure 13:
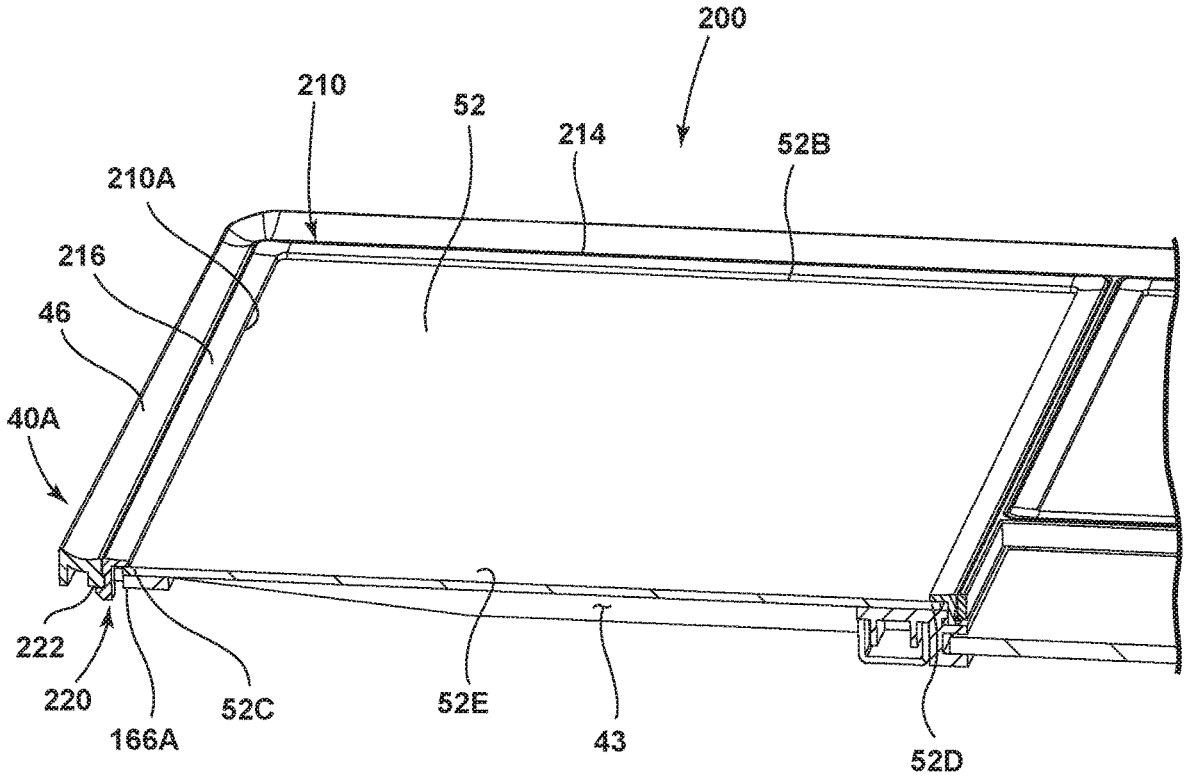
FIG. 13 is a cross-sectional view of the shelf assembly of FIG. 12A, with the glass panel and retaining frame coupled to the frame assembly.

As further shown in FIG. 12A, the first side portion 32 includes front and rear frame members 42, 44 which are interconnected by opposing side frame members 46, 47 to define a peripheral frame assembly 40A that is a subset of frame assembly 40. The support ledge 160 is shown having front and rear portions 162, 164 interconnected by side portions 166, 167. In the embodiment of FIG. 12A, the side portions 166, 167 of the support ledge 160 include respective mounting apertures 166A, 166B and 167A, 167B (FIG. 12B). A retaining frame 210 includes front and rear portions 212, 214 interconnected by opposing side portions 216, 217. In assembly, the retaining frame 210 is configured to retain the glass panel 52 in place on the support ledge 160. The retaining frame 210 includes an inner edge 210A that abuts an upper surface 52E of the glass panel 52 in assembly, as shown in FIG. 13. The side portions 216, 217 of the retaining frame 210 include downwardly extending clip members 220 which are configured to be received in the mounting apertures 166A, 166B and 167A, 167B of the support ledge 160 to clip the retaining frame 210 to the frame assembly 40A to capture the glass panel 52 therebetween. As specifically shown in FIG. 13, the clip members 220 engage an underside 222 of the frame assembly 40A through mounting apertures 166A, 166B and 167A, 167B of the support ledge 160 to retain the retaining frame 210 in place on the frame assembly 40A.

For the purposes of this disclosure, the panels of the shelf systems disclosed herein are described as "glass panels," however, the panels, such as panel 52, may also include panel members comprised of other materials. Other materials may include, for example, polymeric panels, transparent panels, metal panels, and the like. Thus, the present disclosure is not limited to glass panels unless specifically claimed otherwise.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A shelf assembly, comprising:

a frame assembly having front and rear frame members, wherein each of the front and rear frame members include first and second portions vertically spaced-apart from one another and substantially parallel to one another to define front and rear channels, respectively, therebetween, and further wherein the first and second portions of the rear frame member are interconnected by an end wall;

a glass panel having first and second ends, wherein the first end is fully received in the front channel of the front frame member, and further wherein the second end is partially received in the rear channel, such that a gap is defined between an upright end surface of the second end of the glass panel and the end wall downwardly extending from an underside of the first portion of the rear frame member; and at least one spacer assembly having a base portion with one or more spacer members extending upwardly from the base portion and one or more clip members extending upwardly from the base portion, wherein the one or more clip members of the spacer assembly are clipped to one or more mounting apertures disposed through the second portion of the rear frame member, and further wherein the one or more spacer members are received through one or more receiving apertures disposed through the second portion of the rear frame member, wherein the one or more spacer members extend into the gap of the rear channel and engage the upright end surface of the second end of the glass panel when the at least one spacer assembly is clipped to the second portion of the rear frame member.

2. The shelf assembly of claim 1, wherein the one or more spacer members engage the second end of the glass panel on a first side of the one or more spacer members, and further wherein the one or more spacer members engage the end wall of the rear channel on a second side of the one or more spacer members.

3. The shelf assembly of claim 1, wherein the one or more spacer members include a cross-shaped cross-section having front and rear arms and first and second side arms.

4. The shelf assembly of claim 3, wherein the front arm of the one or more spacer members engages the second end of the glass panel, when the at least one spacer assembly is clipped to the second portion of the rear frame member.

5. The shelf assembly of claim 4, wherein the one or more receiving apertures include cross-shaped apertures having a plurality of outwardly extending segments, and further wherein the front and rear arms and the first and second side arms of the one or more spacer members are individually received in respective outwardly extending segments of the cross-shaped apertures of the one or more receiving apertures, when the at least one spacer assembly is coupled to the second portion of the rear frame member.

6. The shelf assembly of claim 1, wherein an upper surface of the base portion of the at least one spacer assembly abuts an underside of the second portion of the rear frame member, when the at least one spacer assembly is clipped to the second portion of the rear frame member.

7. The shelf assembly of claim 1, wherein the front channel includes an end wall extending downwardly from an underside of the first portion of the front frame member into the front channel.

8. The shelf assembly of claim 7, wherein the first end of the glass panel abuts the end wall of the first portion of the front frame member when the at least one spacer assembly is clipped to the second portion of the rear frame member.

9. A shelf assembly, comprising:

a frame assembly having first and second frame members spaced-apart on opposite sides of the frame assembly to define a receiving area therebetween, wherein the first frame member includes a first channel, and further wherein the second frame member includes a second channel having an access slot disposed through an underside thereof;

a panel having first and second ends, wherein the panel is received in the receiving area, and further wherein the first end of the panel is received in the first channel of the first frame member, and further wherein the second end of the panel includes an upright end surface received in the second channel of the second frame member, wherein a gap is defined between the upright end surface of the panel and an end wall extending into the second channel; and a spacer assembly releasably coupled to the second frame member, the spacer assembly having a base portion with first and second arms upwardly extending therefrom, wherein the first and second arms of the spacer assembly are spaced-apart from one another and received in the second channel of the second frame member through the access slot at the gap defined therein, and further wherein the first arm engages the upright end surface of the panel when the spacer assembly is coupled to the second frame member.

10. The shelf assembly of claim 9, wherein the second frame member includes first and second portions vertically spaced-apart to define the second channel therebetween, wherein the end wall downwardly extends from an underside of the first portion of the second frame member.

11. The shelf assembly of claim 10, wherein the second arm of the spacer assembly engages the end wall when the spacer assembly is coupled to the second frame member.

12. The shelf assembly of claim 11, wherein a fastening channel is defined between the first and second arms of the spacer assembly.

13. The shelf assembly of claim 12, wherein the spacer assembly is secured to the second frame member by one or more fasteners.

14. The shelf assembly of claim 9, wherein the access slot is substantially disposed along a length of the second frame member, and further wherein the base portion and the first and second arms of the spacer assembly substantially span the length of the access slot.

15. A shelf assembly, comprising:

a first frame member having upper and lower portions vertically spaced-apart from each other to define a first channel therebetween;

a second frame member spaced-apart from the first frame member to partially define a receiving area therebetween, the second frame member having upper and lower portions vertically spaced-apart from one another to define a second channel therebetween;

a panel having first and second ends, wherein the panel is received in the receiving area and operable between a first position, wherein the second end is received in the second channel, and a second position, wherein the first end is received in the first channel and the second end is received in the second channel, and further wherein a gap is formed between an upright end surface of the panel and an end wall extending inwardly into the second channel when the panel is in the second position; and a spacer assembly removeably received in the gap of the second channel, wherein the spacer assembly engages the upright end surface of the panel to retain the panel in the second position.

16. The shelf assembly of claim 15, wherein the panel includes a panel comprised of glass.

17. The shelf assembly of claim 15, wherein the upper portion of the second frame member includes an end wall extending downwardly therefrom, wherein the gap is defined between the second end of the panel and the end wall.

18. The shelf assembly of claim 15, wherein the lower portion of the second frame member includes at least one receiving aperture disposed therethrough.

19. The shelf assembly of claim 18, wherein the spacer assembly includes a spacer member, and further wherein the spacer member extends into the second channel through the at least one receiving aperture of the lower portion of the second frame member and engages the second end of the panel when the spacer assembly is releasably coupled to the lower portion of the second frame member.

20. The shelf assembly of claim 15, wherein the first end of the panel is positioned inwardly from the upper portion of the first frame member when the panel is in the first position.

* * * * *